US007491338B2

(12) United States Patent
Nino

(10) Patent No.: US 7,491,338 B2
(45) Date of Patent: Feb. 17, 2009

(54) APPARATUS AND METHOD FOR BLOCKING AND CONTROLLING THE RELEASE OF SOLID MATERIALS INTO OR THROUGH A FLUID-FLOW CHANNEL

(76) Inventor: Khalil Ibrahim Nino, P.O. Box 2294, South Gate, CA (US) 90280

( * ) Notice: Subject to any disclaimer, the term of this patent is extended or adjusted under 35 U.S.C. 154(b) by 0 days.

(21) Appl. No.: 10/794,664

(22) Filed: Mar. 5, 2004

(65) Prior Publication Data

US 2004/0173513 A1 Sep. 9, 2004

Related U.S. Application Data

(60) Provisional application No. 60/452,982, filed on Mar. 6, 2003.

(51) Int. Cl.
*E03F 5/14* (2006.01)

(52) U.S. Cl. ..... 210/747; 210/791; 210/131; 210/156; 210/162; 210/163; 210/170.03; 404/4

(58) Field of Classification Search ..... 210/747, 210/791, 131, 156, 162, 163, 164, 170, 407; 404/4, 5

See application file for complete search history.

(56) References Cited

U.S. PATENT DOCUMENTS

| | | | | | |
|---|---|---|---|---|---|
| 231,544 | A | * | 8/1880 | Darst | 210/131 |
| 248,559 | A | * | 10/1881 | Jackson | 404/4 |
| 506,267 | A | * | 10/1893 | Sefton | 210/163 |
| 961,834 | A | * | 6/1910 | Barlett | 210/131 |
| 1,066,316 | A | * | 7/1913 | Piper | 404/5 |
| 1,302,839 | A | * | 5/1919 | Olson | 210/156 |
| 1,666,756 | A | * | 4/1928 | Sass | 210/131 |
| 1,999,637 | A | * | 4/1935 | Pettepher | 210/156 |
| 4,073,147 | A | | 2/1978 | Nomura | |

(Continued)

OTHER PUBLICATIONS

Khalil Ibrahim Nino; Practical Technology (showing CAD drawing of a form of Manual Blocker); approx. Oct-Nov. 2001; 1 page; a copy may have been provided to one or more persons prior to 2002 in Los Angeles (and possibly Orange) County, Calif. (See also, discussion of Manual Blocker in Declaration of Khalil Ibrahim Nino and in IDS at item 3, both filed herein on Dec. 8, 2007.) (The person filing this doc. bases the statements in this NPL item and those below primarily on info. & belief except his direct knowledge of own web research & own prep of submittals to USPTO.)

(Continued)

*Primary Examiner*—Christopher Upton
(74) *Attorney, Agent, or Firm*—Aaron L. Patton

(57) ABSTRACT

The present invention relates to an apparatus and method, using the apparatus, for blocking the passage of solid materials into or through a channel while permitting the passage of fluid; automatically releasing the blocked solid materials under predetermined conditions when priority is given to maximizing the passage of fluid; automatically re-closing after the accumulated solid materials have passed downstream, and resuming the blocking of solid materials; and, repeating the process upon recurrence of the predetermined conditions.

Although the invention relates to street storm-water drainage channels, particularly inlets to catch basins, it can be applied to any fluid-flow channel where blocking the passage of solid materials is important but where there are conditions under which priority should be shifted from blocking the solid materials to releasing them downstream.

20 Claims, 8 Drawing Sheets

U.S. PATENT DOCUMENTS

| | | | | |
|---|---|---|---|---|
| 4,594,157 | A | 6/1986 | McGowan | |
| 4,986,693 | A | 1/1991 | Salberg et al. | |
| 5,232,587 | A | 8/1993 | Hegemier et al. | |
| 5,577,863 | A | 11/1996 | Nottle | |
| 5,643,445 | A | 7/1997 | Billias et al. | |
| 5,702,595 | A | 12/1997 | Mossburg, Jr. | |
| 5,904,842 | A | 5/1999 | Billias et al. | |
| 6,015,489 | A | 1/2000 | Allen et al. | |
| 6,017,166 | A | 1/2000 | Mossburg, Jr. | |
| 6,106,707 | A | 8/2000 | Morris et al. | |
| 6,171,023 | B1 | 1/2001 | Townsend | |
| 6,217,756 | B1 * | 4/2001 | Martinez | 210/163 |
| 6,217,757 | B1 | 4/2001 | Fleischmann | |
| 6,231,758 | B1 | 5/2001 | Morris et al. | |
| 6,402,942 | B2 | 6/2002 | Cardwell et al. | |
| 6,478,954 | B1 * | 11/2002 | Turner et al. | 210/131 |
| 6,668,390 | B1 * | 12/2003 | Gonzalez | 210/163 |
| 6,824,677 | B2 * | 11/2004 | Martinez | 210/163 |
| 6,869,523 | B2 | 3/2005 | Martinez | |
| 6,905,599 | B2 | 6/2005 | Allard | |
| 6,972,088 | B2 | 12/2005 | Yehuda | |
| 6,974,540 | B1 | 12/2005 | Fleischmann | |
| 6,998,039 | B2 | 2/2006 | Harris et al. | |
| 7,070,691 | B2 | 7/2006 | Lindemulder | |
| 7,074,326 | B2 | 7/2006 | Singleton | |
| 7,179,371 | B1 | 2/2007 | Bistline | |
| 7,234,894 | B1 | 6/2007 | Flury | |
| 7,294,256 | B2 | 11/2007 | Happel et al. | |
| 2003/0173277 | A1 | 9/2003 | Shaw et al. | |
| 2005/0035038 | A1 * | 2/2005 | Falton | 210/156 |
| 2008/0014021 | A1 | 1/2008 | Flury | |

OTHER PUBLICATIONS

Khalil Ibrahim Nino; CBTB008 Product Information (a design for a Practical Technology flyer showing above CAD drawing of a form of Manual Blocker and some information about it—a Patent Pending notation was in the original but was an error so is redacted in this copy); approx. Oct-Nov. of 2001; one page; a copy may have been provided to one or more persons prior to 2002 in Los Angeles (LA) County (and possibly Orange County) California. (See also, discussion of Manual Blocker in Declaration and IDS as referred to in item 1 above.).

Khalil Ibrahim Nino; CBTB008 Product Information (a design for a Practical Technology flyer showing photo of an installed prototype Manual Blocker and some information about it—a Patent Pending notation was in the original but was an error so is redacted in this copy); approx. Oct-Nov. of 2001; one page; a copy may have been provided to one or more persons prior to 2002 in LA County (and possibly Orange County) California. (See also, discussion of Manual Blocker in Declaration and IDS as referred to in item 1 above.).

Khalil Ibrahim Nino; Catch Basin Trash Blocker Magnetic Swing Gate (CBTB-MSG); one page (brief & very simplified general description); prepared between approx. mid-Mar. and Apr. 30, 2002, and, during approx. same period, copy provided by Mr. Nino to one or more engineering personnel of the City of LA, in the City of LA, CA. (See further discussion of this item in the Declaration of Khalil Ibrahim Nino filed herein on Feb. 2, 2006 and see the copy of this item filed with that declaration as attachment marked KN Exhibit 3.).

Khalil Ibrahim Nino; 4 photos, 1 on ea. of 4 pgs.; taken about Jun. 2002, showing "the box" prototype substantially as it was when demo'd in about Apr. 2002 by Mr. Nino to Louie & Steven Sprague in LA County, CA. (See further discussion of these photos, "the box," and pre-2002 disclosure of prior crude model aka mock-up to Sprague, in Declarations of Khalil Ibrahim Nino and Louie Sprague, filed herein on Feb. 2, 2006 with copy of these photos as attachments marked KN Exibits 7-10 and LS Exhibits 2-5. These photos did not scan well so a better copy is filled herewith.).

City of Los Angeles (except hand-written portion); Request for Quotation with ID #0000000712 and with first line item described as Installation of Catch Basin Opening Covers; one page; dated Apr. 2, 2002 and published (with other pages that presumably included the technical information in the PO referred to below) in about Apr./May of 2002 in the City of LA, Ca. (See further discussion of this item in the Declaration of Khalil Ibrahim Nino filed herein on Feb. 2, 2006 and see copy of this page filed with that declaration as attachment marked KN Exhibit 11.).

City of Los Angeles; Purchase Order, with PO #0000181535 and with 1st line item described as Catch Basin Opening Covers; 16 pgs. (incl. attached Cond'ns, Specs., Table, Legend & Maps 1 & 2); dated Jun. 21, 2002 for issue to vendor Practical Technology in Downey, CA; and believed published in County of LA. (See further discussion of this item in the Declarations of Khalil Ibrahim Nino and Michael Maliniak filed herein on Feb. 2, 2006 and see copy of these pages filed with the Maliniak declaration, except Map #2 was inadvertently left out so a copy of Map #2 is filed herewith.).

Ammar Eltawil; photos of a prototype CBTB-MSG; 3 pgs., 1 photo/pg.; taken about Jul. 9, 2002 in City of LA within a few days of the installation; copy given to applicant herein on about Jul. 9, 2002 and possibly others within a few days after that, in City of LA. (See further discussion in the Declarations of Khalil Ibrahim Nino & Louie Sprague filed herein on Feb. 2, 2006 with copy of these photos filed as attachments marked KN Exihibts 12, 13 & 14, & 2 of them as attachments marked LS Exhibits 6 & 7. Apparently, the 3 KN Exhibit photos did not scan, so a better copy is filed herewith.).

Khalil Ibrahim Nino; Strainex (CBTB-MSG8), a design for a Practical Technology 2-sided flyer with a photo & info. on each side (to illustrate what a CBTB-MSG looks like, although photo of closed bloker is a Manual Blocker with touch up to remove handle brackets so looks same as CBTB-MSG) and original flyer had a trademark registration near Strainex & 1 pg. had a Patent Pending notation—premature, so are redacted from this copy); approx. Jul. 2002; 2 pgs.; a copy may have been provided to one or more persons in LA (& possibly Orange) County, CA.

Khalil Ibrahim Nino; Strainex (CBTB-MSG-8), a design for a Practical Technology 2-sided flyer with a photo & info. on each side (to illustrate what a CBTB-MSG looks like, although photo showing it closed is same as noted in item 9 above and original flyer had a Patent Pending notation—which was premature, so is redacted from this copy); approx. Jun. 2002; 2 pages; a copy may have been provided to one or more persons in LA (and possibly Orange) County, CA.

Khalil Ibrahim Nino; CBTB-MSG-8 Product Information, 2 early designs for a Practical Technology flyer, one with a basic sketch of a blocker & info. and the other with a photo of "the box" prototype & Info.; approx. first part of Jun. 2002; 2 pages; a copy may have been provided to one or more persons in LA (and possibly Orange) County, CA.

Kristar Enterprises; "FloGard® Trash & Debris Guard"; Internet web site; viewed about Feb. 2, 2008 but first pub. date unknown; 1 web page, with photo & brief desription; publ. on the web at http://www.kristar.com/Trash%20and%20Debris%20Guard%20spec%20.pdf.

Kristar Enterprises; "Flo-Gard™ Trash & Debris Guard"; internet web site; viewed about Feb. 2, 2008 but first pub. date unknown; 2 pages, with drawings; publ. on the web at http://www.kristar.com/dwgs/pdfs/fgtdg.pdf.

United Storm Water; "Protecting Our Water Resources"; a brochure; particularly pp. 1,2,5 & 7 of a total of 13 pages with some reference to company stormwater filtration products including its curb inlet screen covers; viewed on internet about Feb. 6, 2008 but initial pub. date unknown; published on web at http://www.unitedstormwater.com/brochure%20website/usw_new.pdf.

United Storm Water; "CleanScreen™"; an internet web page with a picture and description of a CleanScreen™ gate screen cover for the curb inlet of a catch basin; viewed on internet about Feb. 6, 2008 but initial pub. date unknown; published on the web at http://unitedstormwater.com/brochure%20website/ars01.pdf.

Revel Environmental Manufacturing; company products introduction pages with reference to its curb inlet protectors, including its Triton Curb Protector™ ; 2 pages; viewed on internet about Feb. 2, 2008 but initial pub. date unknown; published on the web at http://www.remfilters.com/uploads/products/b315d0fc33ae523281aaaafa320845997-line-card-3-04.pdf.

Revel Environmental Manufacturing; "Curb Protector™ Product Specification"; 1 page; viewed on internet about Feb. 2, 2008 but initial pub. date unknown; published on the web at http://www.remfilters.com/uploads/products/Curb-Protector-Brochure-9-2005.pdf.

H. A. Guden Co., Inc.; Section titled Catches, Supports and Guides; Online Catalog titled Stock Products; date unknown but viewed on Jan. 26, 2006, and the pages referred to herein are presumed to describe devices that were described in a printed publication, on sale, or in public use prior to Mar. 2002; Catalog section contents page plus pages 38, 39 and 42 of the Catalog; believed published by H. A. Guden Co., Inc., but publication date unknown; published on the internet at http://www.guden.com.

H. A. Guden Co., Inc.; Gas Springs and Dampers; Online Catalog titled Stock Products; date unknown but viewed on Jan. 26, 2006, and the pages referred to herein are presumed to describe devices that were described in a printed publication, on sale, or in public use prior to Mar. 2002; Catalog section contents page plus pp. 44-50 of the Catalog; published by H. A. Guden Co., Inc., but publication date unknown; published on the internet at http://www.guden.com.

Douglas P. Taylor; Article titled History, Design, and Applications of Fluid Dampers in Structural Engineering; Online publication; date unknown but viewed on Dec. 25, 2005 and presumed to have been published prior to Mar. of 2002; pp. 1-3, 6, 7, 11-13, 18-20, and 22-24; published by Taylor Devices Inc., but publication date unknown; published on the internet at http://www.taylordevices.com/papers/history/design.htm.

Author (photographer) believed to be Mr. Wing or Mr. Ammar Eltawil; 3 photos (1 per page) of installed prototype of manual blocker in City of Los Angeles; each photo shows date Nov. 1, 2001 and is believed taken on or before that date; although author may have published them sooner, applicant herein received and sent or showed a copy, within about 2-3 months after the photos were taken, to one or persons in the cities of Santa Monica and Signal Hill, Ca. (See concurrently filed declaration of Khalil Ibrahim Nino for explanation and copy of these pages.).

Khalil Ibrahim Nino; Manual Blocker; two sketches; completed between Nov. 29, 2007 and Dec. 2, 2007; 1 page; not published but illustrating the prototype of manual blocker referred to above as being installed and photographed on or before Nov. 1, 2001 in the City of Los Angeles. (See concurrently filed declaration of Khalil Ibrahim Nino for explanation and copy of this page.).

Khalil Ibrahim Nino; Screen Mounted on Curbside Opening; 2 sketches; completed between Nov. 29, 2007 and Dec. 2, 2007; 1 page; not published but provided to help illustrate The Screen referred blocker referred to by applicant herein as seen by him installed in the City of Los Angeles prior to about Sep. 2001. (See concurrently filed declaration of Khalil Ibrahim Nino for explanation and copy of this page.).

Khalil Ibrahim Nino; Wobble Magnet on Support; 2 sketches (but appearing to be 3 since top sketch has 2 separated parts); completed between Nov. 29, 2007 and Dec. 2, 2007; 1 page; not published but provided to help illustrate the storeroom door with a wobbly magnet doorstep referred to by applicant herein as seen by him installed in the City of Las Vegas, NV, prior to about the end of 2001. (See concurrently filed declaration of Khalil Ibrahim Nino for explanation and copy of this page.).

Engineered Safety Products, LLC; Application for registration of word mark Clean Screen, appliaction serial ™ 76424431; filed at the U.S. Patent and Trademark Office (USPTO) on Jun. 24, 2002 and made public via the USPTO's online TESS system in the course of business thereafter, and published for opposition Sep. 2, 2003; pages identified in their bottom margin as 1, 2 & 4; published on TESS (which has the order of te pages re-arranged); publisher being USPTO, presumably in Arlington, VA. (Copy of these pages filed herewith.).

T. Brousard and Robert F. Beardsley of the Department of Public Works City of Huntington Beach; Approve Sole Source Procurement From Asbury Environment Services for Purchase of Catch Basin Screening Devices; Request for City Council Action; Nov. 1, 2004; pp. 1 (Recommended Action) and 2 (Analysis, first and second paragraphs); publisher being City of Huntington Beach, published on the web at http://www.ci.huntington-beach.ca.us/files/users/city_clerk/111504E10.pdf, presumably in Huntington Beach, CA. (Copy of these pages filed herewith.).

Public Services Department/Engineering Division presented by William J. Morris; Catch Basin Insert Program for 2002/2003 - City Project No. 03-15; Ciry Council Agenda Report (for City of Costa Mesa, Ca); Jul. 11, 2003; pp. 1 (Background, second paragraph), 2 (Analysis), and 3 (Conclusion); publisher being City of Costa Mesa, published on web at http://www.ci.costa-mesa.ca.us/council/agenda/20030721/Award%20Catch%20Basin%20Report.pdf, presumably in Costa Mesa, Ca. (Copy of these pages filed herewith.).

American Storm Water; "We are Dedicated to Developing Premium Storm Water Management Products & Technology"; pub. date of content unknown (but bottom of web p. says copyright 2006); 1 web p. (2 print pp.), with photo of apparent top-hinged screen gate at inlet of catch basin, presumed to be a "Surf Gate"; pub on internet at http://www.americanstormwater.com/Storm_Water_Products/index.html, presumed pub. by author from Torrance, CA.(Copy filed herewith.).

American Storm Water; "Surf Gate's Double Locking Mechanism Makes It A Storm Water Industry Stand Out"; pub. date of content unknown (but bottom of web p. says copyright 2006); 1 web p. (2 print pp.), with photo & ref. to Surf Gate as auto. retractable screen gate that can unlock & open to storm water curb flow, lock into 2ndary position, and return to locked position when debris dislodges; pub. on internet, http://www.american stormwater.com/Storm_Water_Products/surf_gate.html, presumed pub. by author from Torrance, CA (Copy filed herewith).

Santa Clara Valley Urban Runoff Pollution Prevention Program: "Screens and Racks", part of Trash BMP Tool Box dated Sep. 2007 (presumed to be pub. date); pp. 1-2, 5 & 7-9 (catch basin screens, noting (p. 2) they manually or hydraulically open and (p. 5) experiments done in 2000, but it seems 2002a cite should be 2002b, item #7 below), and p. 10 (ref. to sources & dates); pub. on internet, http://www.scvurppp-w2k.com/trash_bmp_toolbox_2007/Screen%20&%20Racks.pdf, presumed pub. by author form Sunnyvale, Ca. (Copy filed herewith.).

County of Los Angeles Dept. of Public Works; Category - Drain Inlet Protection; BMP Yellow Pages; pub. date of content unknown (but bottom of web pg. said copyright 2005, viewed about Feb. 8, 2005); 1 web pg. (3 print pp.) ref. to vendors & products, including item #4 comment on Asbury Env. Svcs. "Clean Screen" re LACDPW pilot installations on 91 catch basins county-wide; pub. on internet, http://www.dpw.lacounty.gov/wmd/bmp/YellowPages/specifics.cfm?title=Category&field=Drain%20Inlet%20Protection, presumed pub. by author from LA, CA, (Copy filed herewith).

Miriam Gordon & Ruth Zamist; "Municipal Best Management Practices for Controlling Trash and Debris in Stormwater and Urvan Runoff"; pub. believed 2006 per ref. in item #3 above; title p. & pp. 4, 8-11 (struct. controls - opening screen covers), 12 (mag. & flow activ., & auto. retract.), 47-55 (Appxs. 2 & 3, devices, vendors & some install. data), & pp. 56-57 (ref. to sources & dates); pub. on internet, http://www.plasticdebris.org/Trash_BMPs_for_Munis.pdf, presumed pub. by Plastic Debris Rivers to Sea Project from Long Beach, CA (Copy filed herewith.).

County of Los Angeles Department of Public Works, Watershed Management Division, Water Quality Section; "Technical Report on Trash Best Management Practices" date Aug. 5, 2004 (presumed to be pub. date, but pdf file notes a "rev. Jul. 22, 2004"), title p., pp. 3, 8, 13-14; pub. on internet, http://www.ladpw.org/wmd/BMP/TrashTechReport/TrashTechnicalReportFinal8-5-04.pdf, presumed pub. by author from LA, CA (Copy filed herewith.).

City of Los Angeles, Department of Public Works, Bureau of Sanitation, Watershed Protection Division; "High Trash-Generation Areas and Control Measures" dated Jan. 2002 (presumed ot be pub. date, but bottom margin of pg. 8 notes a "Rev. jan. 11, 2002"); title p. and pp. 8 (rev. date in bottom margin), 16 (structural trash controls) and 18 & 22 (catch basin opening covers); pub. on internet, http://www.lacity.org/san/wpd/siteorg/download/techman.htm, presumed pub. by author from LA, CA. (Copy filed herewith.).

Kristar Enterprises; "KristarFloGardSpec.pdf Properties"; properties window of the pdf file used to publish the "FloGard® Trash & Debris Guard" web page referred to in NPL item 14 of IDS filed herein on Feb. 11, 2008; downloaded about Feb. 6, 2008 but pub. date presumed on or before pjd "created" date of May 7, 2007 (the "04/07" at the bottom of NPL item 14 document may indicate an earlier pub.

date for it); 1 page; published at http://www.kristar.com/Trash%20and%20Debris%20Guard%20spec%20.pdf; presumed pub by author at Santa Rosa, CA. (Copy filed herewith).
Kristar Enterprises; "KristarFloGardDwg1.pdf Porperties"; properties window of pdf file used to pub. the "Flo-Gard™ Trash & Debris Guard" pages referred to in NPL item 15 of IDS filed herein on Feb. 11, 2008; downloaded about Feb. 6, 2008 but pub. date presumed on or before pdf "created" date of Jun. 18, 2004 (which is consistent with the "06/04" in title boxes of the NPL 15 document); 1page; publ. at http://www.kristar.com/dwgs/pdfs/fgtdg.pdf; presumed pub. by author at Santa Rosa, CA. (Copy filed herewith.).
United Storm Water "UnitedGeneralBrochure.pdf Properties"; properties window of pdf file used to pub. the "Protecting Our Water Recourses" brochure referred to in NPL item 17 of IDS filed herein on Feb. 11, 2008; downloaded about Feb. 6, 2008 but pub. date presumed on or before pdf "created" date of Apr. 9, 2007; 1 page; published at http://www.unitedstormwater.com/brochure%20website/usw_new.pdf; presumed pub. by author at LA (City of Industry), CA. (Copy filed herewith.).
United Storm Water; "UnitedCleanScreenBrochure.pdf Properties"; properties window of pdf file used to pub. the "CleanScreen™" web page referred to in NPL item 18 of the IDS filed herein on Feb. 11, 2008; downloaded about Feb. 6, 2008 but pub. date presumed on or before pdf "created" date of Apr. 9, 2007; 1 page; published at http://www.unitedstormwater.com/brochure%20website/ars01.pdf; presumed pub. by author at Los Angeles (City of Industry), CA. (Copy filed herewith.).
Revel Environment Manufacturing; "REM_Intro.pdf Properties"; Properties window of pdf file used to pub. the "company products introduction"pages referred to in NPL item 19 of the IDS filed herein on Feb.11, 2008; downloaded about Feb. 6, 2008 but pub. date presumed on or before pdf "modified" on Mar. 3, 2004 possibly on or before "created" on Jan. 7, 2004; 1 pg.; pub. at http://www.remfilters.com/uploads/products/b315d0fc33ae523281aaafa320845997-line-card-3-04.pdf; presumed pub. by author at Santa Ana, CA. (Copy filed herewith.).
Revel Environmental Manufacturing; "Curb-Protector-Brochure9-2005.pdf Properties"; properties window of pdf filed used to pub. the "Curb Portector™ Product Specification" referred to in NPL item 20 of the IDS filed herein on Feb. 11, 2008; downloaded about Feb. 6, 2008 but pub. date presumed on or before pdf "created" date of Sep. 29, 2005; 1 pg.; published at http://www.remfilters.com/uploads/products/Curb-Protector-Brochure-9-2005.pdf; presumed by author at Santa Ana, CA. (Copy filed herewith.).

* cited by examiner

APPARATUS AND METHOD FOR BLOCKING AND CONTROLLING THE RELEASE OF SOLID MATERIALS INTO OR THROUGH A FLUID-FLOW CHANNEL

CROSS-REFERENCE TO RELATED APPLICATIONS

This application is derived from U.S. Provisional Application No. 60/452,982, filed Mar. 6, 2003, and claims priority based upon the filing date of said Provisional Application.

BACKGROUND OF THE INVENTION

The present invention relates to an apparatus for blocking the passage of solid materials into or through a channel while permitting the passage of fluid. More particularly, the present invention relates to such an apparatus that also automatically releases accumulated solid materials under predetermined release conditions in which release is deemed to take priority over continued blocking, and automatically re-close after the accumulated solid materials have been released. The present invention also relates to a method (sometimes referred to herein as process) for controlling the passage of solid material into or through a channel; and more particularly, to such a method that utilizes an apparatus embodying the present invention to block the passage of solid materials, hold the accumulated solid materials until the occurrence of predetermined release conditions, automatically release the solid materials, automatically resume blocking and accumulating solid materials, and automatically repeat the process upon recurrence of the predetermined release conditions.

As used in this specification, "solid material" means any item of natural or man-made solid material, including any comprised of trash, debris, vegetation, one or more sticks, one or more rocks, all or part of an animal, or any combination thereof, that has at least one dimension larger than a predetermined size. Such solid material is also referred to herein singly and plurally simply as "trash." Selection of the predetermined (maximum) size for the solid material that will be permitted to pass through an aperture is often based on use of a hypothetical model of the solid material. The hypothetical model typically is a spherical shape that is rigid (neither elastic nor flexible). Of course, many forms of solid material are not spherical in shape or are not rigid; and those solid materials can sometimes pass through an aperture that is smaller than the solid material's maximum dimension, which may be due to the solid material's orientation upon reaching the aperture or to its compressibility or flexibility. Thus, an aperture that is intended to block solid materials of a predetermined size should not be expected to stop all solid materials with a dimension larger than that size.

As used in this specification, "channel" (whether used alone or directly after "fluid" or "fluid-flow") means any inlet, catch basin, channel, conduit, pipe, culvert, tube or any other man-made or natural confinement, or any system comprising some or all of these elements, through which fluid flows on at least some occasions. Channels, particularly drainage channels, often include a catch basin. The catch basin is typically located near the channel's beginning point; that is, near the point at which fluid first enters the channel system.

As used in this specification "fluid" means any fluid, or combination of fluids, that is normally or reasonably expected to be carried by the channel in which the apparatus is installed.

Solid materials tend to be moved by fluid and thereby enter into channels that collect or direct the flow of the fluid. It is generally desirable to minimize the amount of solid materials in the channel that are too large for the channel to move throughout its length during light or moderate flow periods. It is also desirable to minimize the amount of solid materials that pass through the channel and are large enough to create an environmental, aesthetic, health, or other problem at the discharge end of the channel. On the other hand, it is desirable for channels to be available for receiving and moving large amounts of fluid during heavy flow periods. The need for these desirable features is particularly apparent when considered in the context of a street or highway storm drain system.

Streets and highways frequently have curb inlets leading to catch basins as the initial entry points of drainage systems for collecting and draining water and other fluids that would otherwise accumulate in and ultimately flood the street or highway. It is desirable to minimize the entry of solid materials that are larger than a relatively small size, in order to reduce the frequency needed for cleaning such materials out of the system and the potential for animals or even small children entering through the inlets.

It may be observed that most curb inlets have no effective means for blocking the entry of trash. There have been ideas put forward that involve installation of a trash blocking device at the inlet but typically those devices require manual cleaning or removal to relieve the damming effect of an accumulation of trash during periods of heavy fluid flow. (See, e.g., U.S. Pat. No. 4,986,693, issued to Salberg et al. on Jan. 22, 1991; U.S. Pat. No. 5,702,595, issued to Mossberg on Dec. 30, 1997; U.S. Pat. No. 6,017,166, issued to Mossberg on Jan. 25, 2000; and, U.S. Pat. No. 6,402,942, issued to Cardwell et al. on Jun. 11, 2002.) The accumulation of trash during dry, light, or moderate flow periods is inconsequential because the accumulated materials do not significantly impede the flow of a modest volume of fluid into the drainage system. During such periods, street and highway maintenance personnel have no immediate need to clear the curb inlets and are at liberty to do so according to a predetermined schedule without significant risk of a flood occurring.

However, during periods of heavy flow, due to storms or other events that produce substantial amounts of fluid in the streets and highways, it is imperative that any significant impediment to the flow of such fluid into the drainage system be removed. These heavy flow periods often commence unexpectedly or on very short notice and, in some geographical areas, frequently. Thus, installation of most previously proposed blocking devices into curb inlets would put maintenance personnel under extreme pressure to mount an intensive and expensive effort to remove the blocking devices whenever heavy flow periods occur. Removal of such blocking devices generally requires personnel to expend substantial time and, in some cases, to use expensive equipment in order to access and remove the connecting means and the devices.

Nevertheless, such removal is necessary because the trash accumulated at the face of the blocking devices significantly impedes the large volume of fluid that is flowing into the drain system, thus causing a damming effect. Also, the blocking devices will continue to block and accumulate the additional trash that is being carried with the large volume of fluid, exacerbating the damming effect. Therefore, unless agencies that have responsibility for street and highway maintenance and/or flood control either forgo the benefits of having blocking devices or expend large sums for personnel and equipment to immediately remove the blocking devices every time a heavy flow period threatens or commences, the accumulations at the entrances to their drainage systems are very likely to cause substantial flooding.

It has been suggested that a blocking device made of elastic plastic material is needed to overcome the prohibitive cost, weight, and installation difficulties, found in blocking devices made of metal or other non-plastic material. And, further, that the prior devices made of metal or other non-plastic material are not particularly suitable for installation within a curb inlet and generally do not, without human assistance, clear the accumulated trash during periods of heavy flow. It has also been contended that attaching the heavy components of metal blocking devices with bolts anchored within the inlet or catch basin will weaken and over-stress that structure. (See U.S. Pat. No. 6,015,489, issued to Allen et al. on Jan. 18, 2000, which discloses a plastic self-relieving curb inlet filter that is secured by adhesive along its top edge within the curb inlet and is sufficiently elastic to flex inward in response to increasing pressure and unflex toward its closed position as the pressure is reduced.) Such a device offers advantages that may be achieved by the use of plastic and adhesive materials. However, the advantages also appear limited because of the use of those materials. The strength, flexibility and elasticity of plastics and adhesives may be adversely affected by repeated flexing and extended exposure to environmental conditions such as sun, air, water, and extreme temperature variations (ranging from above 100 degrees Fahrenheit to well below 0 degrees Fahrenheit in some geographical areas). A secure bond may be difficult to achieve or maintain in circumstances where the surface (generally made of concrete) suffers from irregularities, impurities, or mechanical weaknesses; and, if achieved, may be difficult to remove without some damage to the surface or the device. And, the efficacy of the device in opening and closing is dependent on the elasticity of the material used. Thus, if a very elastic material is used, the device may open with little pressure applied, such as during periods of light to medium fluid flow when remaining closed is generally desired. And, if a very inelastic material is used, the device may not open fully even when the initial resistance is overcome by a large pressure (the degree of resistance increasing with the degree of flexure), which is generally when full opening is most desired. Such a device, therefore, provides no effective means of control to assure the blockage is maintained when that is most desirable and released when that is most desirable.

Consequently, it appears that prior efforts at blocking the passage of trash in channels, and particularly in catch-basin curb inlets, were directed primarily at the use of heavy metal or other heavy materials for devices that were expensive and difficult to install and remove. It also appears that those efforts did not address or suggest a practical and economical solution to the problem of trash accumulation and blockage during heavy flow periods when the passage of fluid needs to be maximized. Apparently perceiving that metals and similar materials were unsuitable for solving the problem, a proposal was made in at least one patent (discussed above) to use elastic plastic material for making a device that would open and close in response to the pressure caused by flow/debris accumulation. However, it may be seen that elastic plastic materials do not have many of the advantages afforded by metals and other strong and substantially rigid materials, and that the prior art using such elastic plastic materials has significant deficiencies, including lack of effective control over the release of accumulated trash.

The present invention provides advantages not afforded by the relevant prior art and does so in a manner that appears both unanticipated by and inconsistent with suggestions in the relevant prior art.

SUMMARY OF THE INVENTION

The present invention relates to an apparatus, and a method using the apparatus, for controlling the entry of solid materials having at least one dimension larger than a predetermined acceptable size (such oversized materials are also referred to herein as "trash") into or through (depending on whether the apparatus is placed at the inlet or elsewhere within) a fluid-flow channel; wherein, the apparatus includes at least one support piece (support); a grid having a closed position and open positions; a means for rotatably connecting the grid to at least one support; a means for holding the grid in its closed position under normal conditions and releasing the grid to rotate into an open position under predetermined release conditions (such means is also referred to herein as a "hold-release means"); and, a means for returning the grid to its closed position after said solid-material accumulation has cleared the grid, wherein the grid is again held in its closed position by the hold-release means.

The present invention also relates to all embodiments of such an apparatus wherein at least one support connects to the channel.

The present invention also relates to all embodiments of such an apparatus wherein the grid defines a plurality of apertures with dimensions adapted to be small enough to block solid materials that are larger than a predetermined size, but large enough to permit passage of fluids.

The present invention also relates to all embodiments of such an apparatus wherein the grid is rotatably connected to at least one support whereby the grid can be in a closed position with the front face of the grid substantially perpendicular to the direction of flow through the channel and can open by swinging in the general direction of said flow, and wherein, in some embodiments, the connection can be via a rod that is connected along its length to the upper edge of the grid and rotatably connected to the support(s).

The present invention also relates to all embodiments of such an apparatus wherein there is at least one hold-release means connecting the grid to at least one support.

The present invention also relates to all embodiments of such an apparatus wherein the hold-release means holds the grid in its closed position until predetermined release conditions occur, at which time such hold-release means releases the grid and, upon return of the grid to its closed position, reconnects the grid to the support and again holds the grid closed.

The present invention relates to all embodiments of such an apparatus wherein gravity is the means for returning the grid to its closed position after it has rotated to allow release and passage of accumulated trash; to all embodiments of such an apparatus wherein gravity is supplemented or replaced by any conventional torque-inducing means for applying torque to the grid in the proper direction to return the grid to its closed position; and, to all embodiments of such apparatus wherein the closing speed of the grid is slowed or otherwise governed by addition of a conventional speed-governing device, such as (but not limited to) a damper.

The present invention also relates to a method (process) that uses any embodiment of such an apparatus to: block and accumulate trash that is carried toward or into the channel in which the apparatus is installed; automatically release such accumulated trash under predetermined release conditions;

automatically re-close and resume blocking and accumulating trash; and, automatically repeat the foregoing process in the event of a recurrence of the predetermined release conditions.

An object of the present invention is to provide an apparatus for performing the functions described herein that can be made of lightweight, strong, and durable materials.

Another object of the present invention is to provide such an apparatus that is simple and economical to make, transport, and install.

Another object of the present invention is to provide such an apparatus that can be installed using readily-available and effective means for connecting it to the channel and for connecting its components to one another.

Another object of the present invention is to provide such an apparatus that is sufficiently adaptable for installation into many different types of channels and environments.

Another object of the present invention is to provide such an apparatus that has the capability of adding or subtracting components or being combined with other such apparatuses to suit differing installation requirements.

Another object of the present invention is to provide such an apparatus that can be constructed from a variety of materials.

Another object of the present invention is to provide such an apparatus that is not subjected to any significant amount of failure-inducing structural bending fatigue.

Another object of the present invention is to provide such an apparatus that is light in weight and capable of being installed and retained within a channel without undue stress on the channel structure.

Another object of the present invention is to provide a method for automatically blocking, accumulating, holding, and under predetermined release conditions releasing trash, and then re-closing and repeating that process each time the predetermined release conditions recur.

BRIEF DESCRIPTION OF THE DRAWINGS

The present invention will be more clearly understood by reference to this specification in view of the accompanying drawings, in which.

DETAILED DESCRIPTION OF PREFERRED EMBODIMENTS

Figure 1:
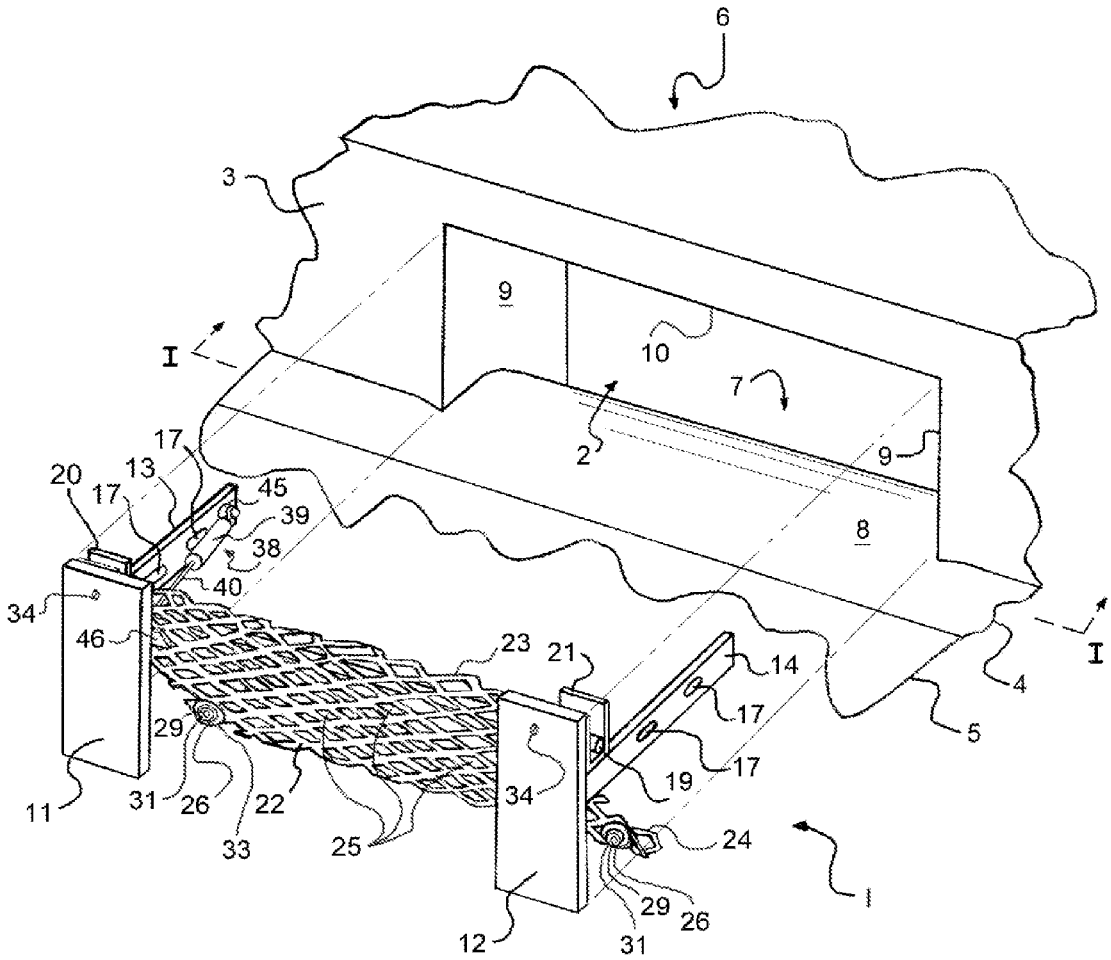
FIG. 1 is a perspective view of a preferred embodiment of the invention apparatus adapted for attachment to the side walls of the curb inlet of a street storm-water catch basin, prior to installation.

As used throughout this specification, unless expressly stated otherwise, the following terms have the definitions referred to or specified in this paragraph. The term "embodiment" means embodiment of the present invention. The term "blocker" is used as a generic term meaning any physical embodiment. The term "trash" has the meaning given to it in the BACKGROUND OF THE INVENTION section, with the predetermined size being whatever size of trash the user of the blocker wishes to prevent (presumably with an exception for predetermined release conditions) from passing to the downstream side of the installed blocker (with due consideration to the fact that some trash that is non-rigid or that has a dimension smaller than the predetermined size might not be blocked). The terms "fluid" and "channel" each have the definition set forth in the BACKGROUND OF THE INVENTION section. The terms "left" and "right" are intended to mean such directions as viewed from the upstream side of the blocker (these directions are described more fullt below in reference to the figures). The term "front" means the upstream side and the term "back" means the downstream side. The terms "vertical" and "horizontal" are intended to include directions that are substantially vertical and substantially horizontal, respectively. The term "predetermined release conditions" means the conditions of pressure and its distribution against the front face of the blocker's grid (discussed below) that are deemed by the user of the apparatus to be the appropriate conditions for shifting priority from blocking trash to releasing it into the downstream part of the channel. The term "pull limit" as applied to a magnet or any other hold-release means is the pulling force needed to disconnect the installed magnet, or other hold-release means, from its holding position, i.e., its position when holding the blocker grid closed. The term "release" means physically disconnecting from a structure or other part, even though there may be some continuing attraction force between them, such as when a magnet disconnects but remains attracted (though to a lesser degree) to the item from which it has disconnected. The term "other hold-release means" refers to any conventional mechanical or electro-mechanical means for releasably holding a blocker grid in its closed position. The term "opposing force" means a force pulling a magnate, or other hold-release means, in a direction opposite the direction of the force applied by the magnet, or other hold-release means, to maintain its holding position against the tendency of the grid to open.

Embodiments include self-actuating fluid-flow trash blockers that are intended for installation in curb inlets or other channels that lead to catch basins or other parts of street storm-water drainage systems. Referring to the drawings, FIGS. 1–6 show a first preferred embodiment that is particularly suited for attachment to the side walls of the channel. Said first preferred embodiment is designated for reference purposes herein as the side-mounted blocker. FIGS. 7–10 show a second preferred embodiment that is particularly suited for attachment to the ceiling of the channel. Said second preferred embodiment is designated for reference purposes herein as the top-mounted blocker.

FIG. 1 shows a perspective view of a side-mounted blocker 1, without its attachment bolts, and illustrates its position prior to being installed in a pre-existing environment comprised of a curb inlet 2 a curbside 3, and inlet apron 4 that is imbedded in a street 5. (Of course, in practice, parts of the blocker may be assembled during its installation so need not actually be pre-assembled or positioned as illustrated in FIG. 1, or in FIG. 7 discussed below, prior to the installation.) As shown, the inlet 2, the curbside 3, and the inlet apron 4 are parts of a catch basin 6 that also has a main chamber 7. The inlet 2 is a channel that commences at the curbside 3 and ends at the catch basin main chamber 7, and is confined by an inlet floor 8, inlet side walls 9, and an inlet ceiling 10. The inlet apron 4 helps direct fluid, and any trash carried with it, from the street environment toward the inlet 2, which then channels said fluid and trash into the catch basin main chamber 7. In FIG. 1, the side walls 9 run substantially straight back from the curbside 3 to the main chamber 7. After passing through the main chamber 7, said fluid and any trash carried with it flow into downstream parts of the storm-water drainage system that the catch basin 6 is part of.

Figure 2:
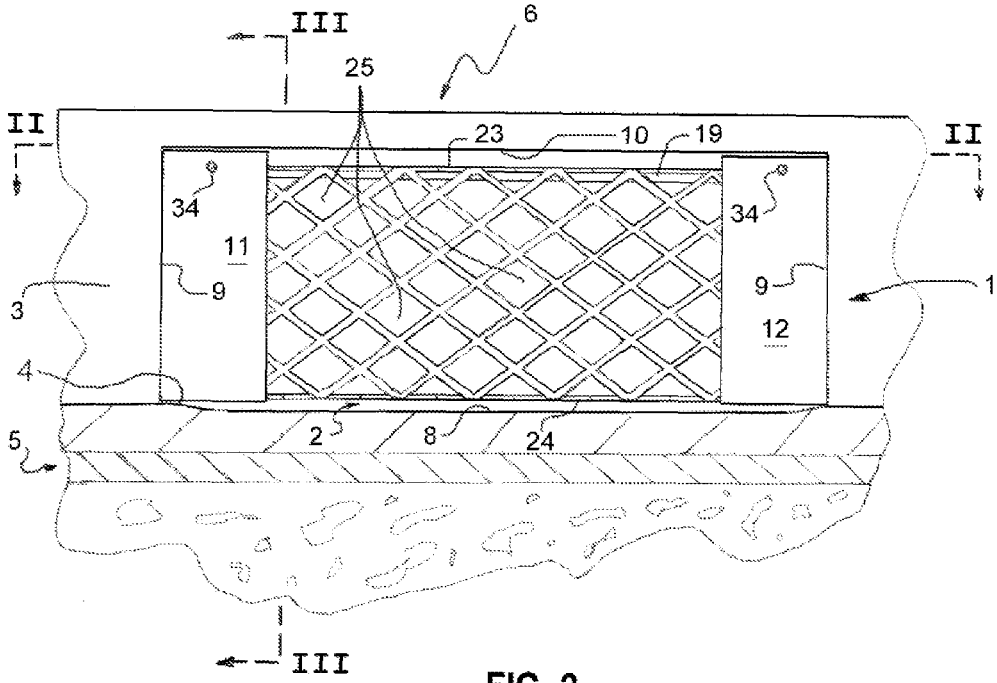
FIG. 2 is a cross-sectional view through I—I showing the front of the embodiment in FIG. 1, as installed in the curb inlet of a street storm-water catch basin.

The side-mounted blocker 1 has a left front support 11 and a right front support 12. As seen in FIG. 2, each of the front supports 11,12 is adapted to fit substantially adjacent to the side wall 9 on the left and on the right, respectively, and to substantially fill the vertical space of the inlet 2 at the locations where they are installed. Each of the front supports 11,12 should be no wider than is necessary to support the parts connected to it, as discussed in more detail below, and to substantially cover the lateral extremes of the inlet 2.

Figure 3:
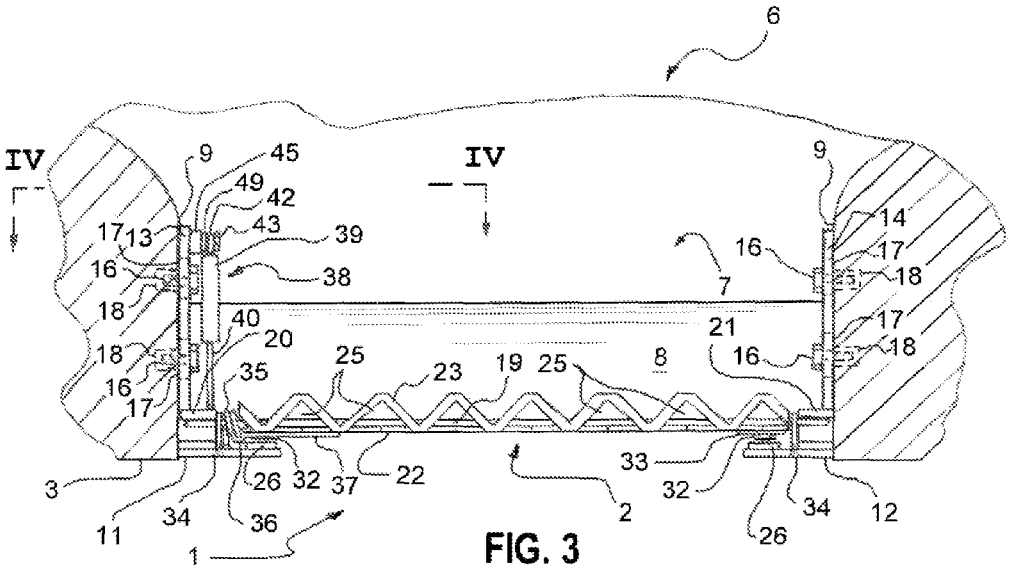
FIG. 3 is a cross-sectional view through II—II showing the top of the embodiment in FIG. 1, as installed in the curb inlet of a street storm-water catch basin.

Referring to FIGS. 1 and 3, it can be seen that the left front support 11 is connected at its left edge to a left side support 13, preferably with the left surface of the left side support 13 positioned flush with the left edge of the left front support 11. And, the right front support 12 is connected at its right edge to a right side support 14, preferably with the right surface of the right side support 14 positioned flush with the right edge of the right front support 12. These figures (and FIGS. 4-6) show that side supports 13, 14 and front supports 11, 12 form a pair of (left and right) support structures of the illustrated side-mounted blocker 1 for mounting grid 22 within inlet 2, with each of the side supports 13, 14 exemplifying a conventional mounting support that is suitable for connecting the support structure of which it is a part, to one of the walls 9. Alternative embodiments (not shown) can use more than one left side support 13 and more than one right side support 14. The front supports 11,12 and the side supports 13,14 preferably are made of hot-dipped galvanized steel, but can be made of any conventional material that is strong and durable in the presence of the fluids reasonably expected to pass through the channel in which they are installed. Such other materials include stainless steel, aluminum, plastics, carbon fibers, and composites. For ease and economy of construction and use, the front supports 11,12 and side supports 13,14 preferably are substantially flat plate shapes. Of course, all parts used in the blocker should be selected to be compatible with the fluid that is expected to be in the channel and with one another, particularly when different metals are being used, to avoid unacceptable levels of corrosive and electrolytic damage to them.

Any reference herein to an item being made of hot dipped galvanized metal or hot dipped galvanized steel, is intended to mean that for best results, the items should be connected before they are treated by the hot-dipped galvanizing process. This is particularly so when the connection is to be made by welding. Those skilled in the art will already understand that this and many other means of connecting items together are best performed before the protective coating is applied. Otherwise, the very coating applied to the item for protection can itself be damaged by heat or impacts produced in making the connection. And, even if not so damaged, the resulting connection is likely to be weakened by the presence of the coating material between the two items.

As examples and not limitations: front supports that are 2 to 4 inches wide, slightly smaller in height than the inlet opening (generally around 8 to 14 inches), and 3/16 inch thick; and, side supports that are 2 inches wide, 8 to 12 inches long, and 3/11 to 3/16 inch thick, have been found to work effectively—with the larger width particularly preferred for a front support that must accommodate a spring or damper (described below in reference to FIGS. 1–6).

Of course, there may be installation environments where the inlet does not have side walls that run substantially straight back from the curbside, but rather run back at an angle or curvature that causes the inlet to widen as it approaches the main chamber of the catch basin. In those circumstances, it may be difficult to connect the side supports to the side walls. In those or any other circumstances where use of side supports is not practical, another embodiment, such as the top-mounted blocker, shown in FIGS. 7–10 and discussed below, can be used.

The connections between front supports 11,12 and their respective side supports 13,14 preferably are fixed and made by welding the front end of the side support 13,14 to the back face of its respective front support 11,12. In other embodiments (not shown), the front supports and their respective side supports can be connected either fixidly or flexibly by any other conventional connection means such as hinges, bolts with or without nuts, screws, brackets, adhesives, or forming them from or as a single piece such as by bending, pressing, stamping or molding the piece; provided that the side supports are adapted to hold the front supports firmly in place when the side supports are connected to the side walls.

Welding beads 15 are shown in FIGS. 4–6 and 10 to illustrate welding connections. Of course, if non-metallic materials are used for the parts being connected, welding (and the welding beads) would be replaced by another conventional connection means suitable for use with those materials.

Figure 4:
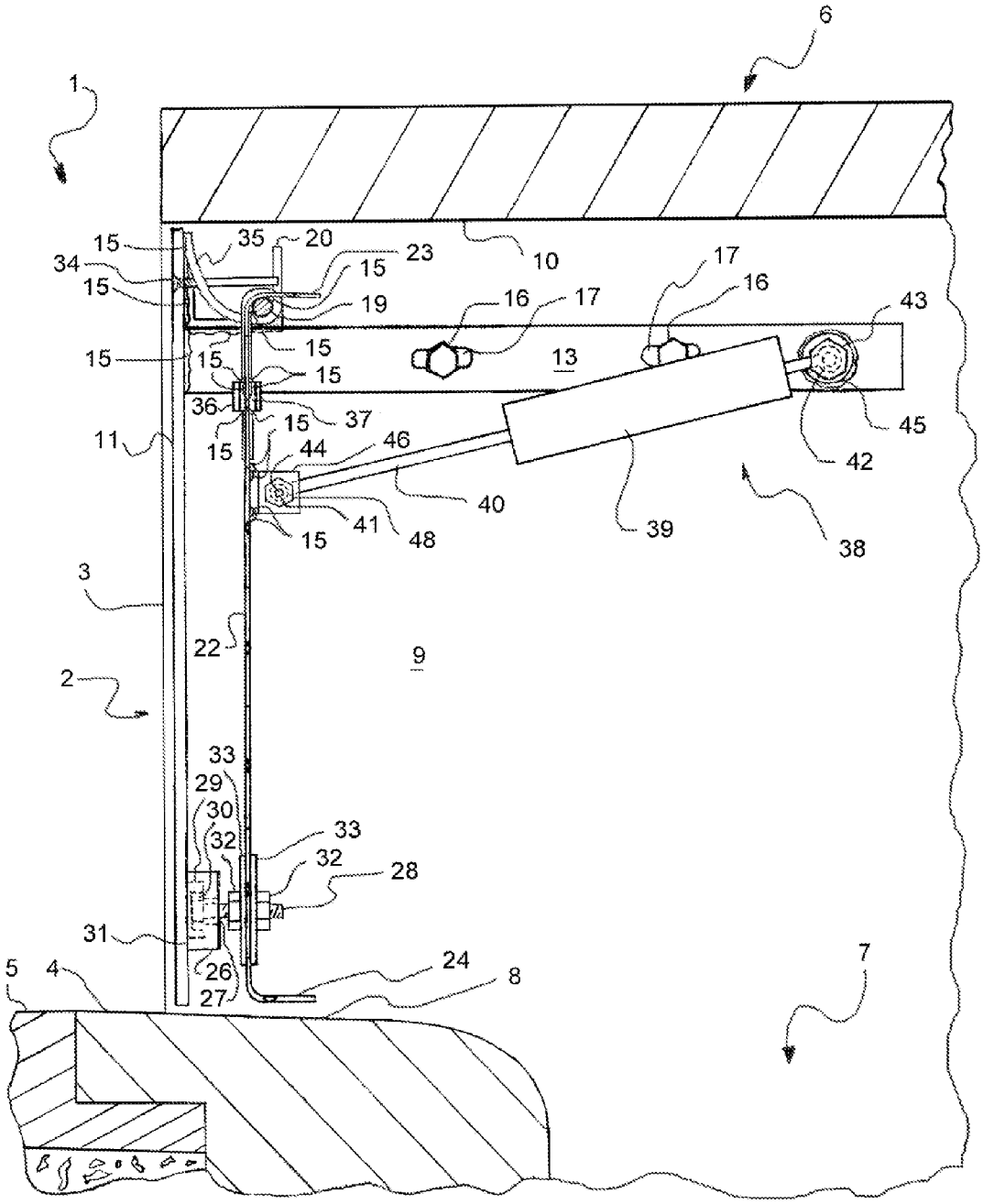
FIG. 4 is a cross-sectional view through III—III showing the left side of the embodiment in FIG. 1 in its closed configuration, as installed in the curb inlet of a street storm-water catch basin.
Figure 5:
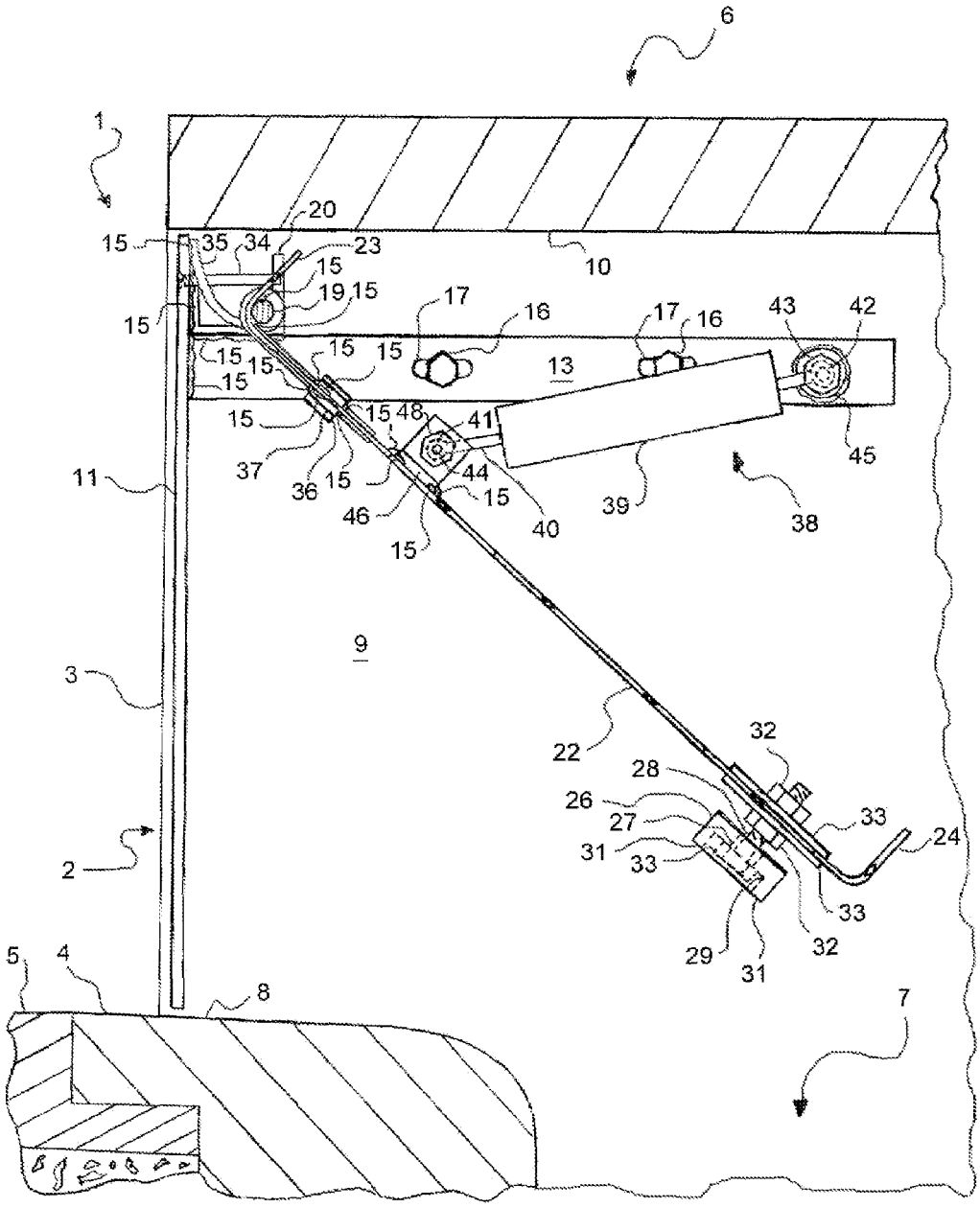
FIG. 5 is a cross-sectional view through III—III showing the left side of the embodiment in FIG. 1 in an open configuration, as installed in the curb inlet of a street storm-water catch basin.

Each of the side supports 13,14 is connected to the side wall 9 on its respective side by at least one support bolt 16, preferably two, as shown in FIGS. 3–5, with each support bolt 16 passing through a support bolt hole 17 and being secured, as shown in FIG. 3, into a bolt anchor 18. Preferably, the support bolt holes 17 are longer and wider than the diameter of the support bolt 16, in order to facilitate adjusting the position of the blocker during installation. In other embodiments (not shown), the side supports 13,14 can be connected to the side walls 9 by any other conventional means such as screws, dowels, adhesives, welding (if the side wall 9 provides a secure metal base suitable for such connection), or bolts not requiring bolt anchors.

Figure 6:
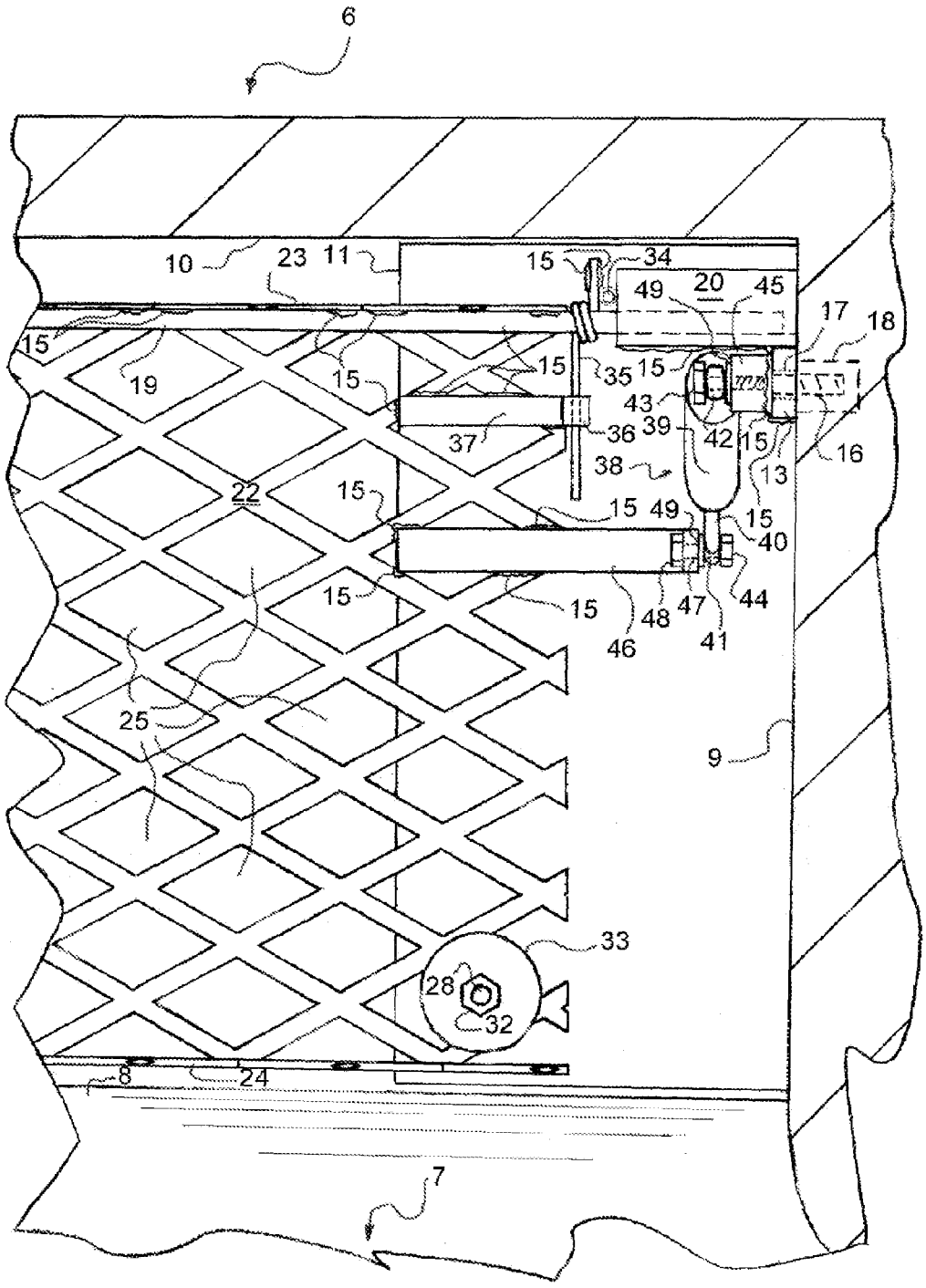
FIG. 6 is a cross-sectional view through IV—IV showing the back of the left portion (appearing on right side when viewed from the rear) of the embodiment shown in FIG. 1, as installed in the curb inlet of a street storm-water catch basin.

As shown in FIGS. 1–3 and (in part) in FIGS. 4–6, a rod 19 extends from approximately the left edge of the left front support 11 to the right edge of the right front support 12. The rod 19 is located behind the front supports 11,12, preferably as close to the top of the front supports 11,12 as is possible while providing the clearance needed for the blocker to open fully as discussed below. The rod 19 preferably is made of the same type of material as are the front supports 11,12 and side supports 13,14, but alternatively can be made of any of the other types of conventional materials that are noted above as alternative materials for making the front supports or side supports. The material and the diameter of the rod 19 should be selected to assure that the rod 19 is sufficiently rigid to avoid significant distortion when held only at each end under anticipated conditions in the installation environment with a grid, magnets, and any other anticipated items attached to it. As an example and not as a limitation, using a rod made of hot-dipped galvanized steel with a diameter ranging from about ½ inch to ⅝ inch together with a grid having overall frontal dimensions of about 8 to 14 inches in height and 3 to 8 feet in width, and grid apertures in substantially the same shape and proportions as shown in the accompanying drawings, has been found to work effectively.

Referring to FIGS. 1–6, it can be seen that the rod 19 is rotatably held by a left rod support 20 and by a right rod support 21. Preferably, the rod supports 20,21 are open-topped channels with a rectangular cross sectional shape as seen through III—III, each with a length, in the direction of the rod 19, that is approximately half the width of the front support 11,12. In other embodiments (not shown), the rod supports can be shaped to have any cross sectional shape that is suitable for holding the end of the rod, such as a "U" or "L" shape, and can be any length that is sufficient for the rod support to hold the rod under conditions reasonably anticipated in the inlet environment.

As seen in FIGS. 1 and 3, the left rod support 20 is connected to the left front support 11 and the right rod support 21 is connected to the right front support 12. The connection between the front supports 11,12 and their respective rod supports 20,21 preferably, as shown in FIGS. 3–6, is by welding the front side (or toe, if the rod support is "L" shaped) of each of the rod supports 20,21 to the back surface of its respective front support 11,12. In an alternative embodiment, the connection between the front supports 11,12 and their respective rod supports 20,21 can be by any other conventional means such as bolts with or without nuts, brackets, screws, adhesives, or forming them from or as a single piece. Also, preferably, as shown in FIGS. 3–6, each of the rod supports 20,21 is also connected to the proximate one of the side supports 13,14, preferably by the same means used for connecting such rod support 20,21 to its respective front support 11,12. Although, in another embodiment (not shown), any other conventional connection means, such as any of those noted above for connecting the front supports 11,12 to their respective side supports 13,14, can be used. The rod supports 20,21 preferably are made of the same kind of material that the front supports 11,12, side supports 13,14, and rod 19 are made of, but alternatively can be made of any of the other types of conventional materials that are noted above as alternative materials for making the front supports 11,12 or side supports 13,14. Preferably, as shown in FIGS. 1, 3, and 6, the left edge of the left rod support 20 is substantially flush with the left edge of the left front support 11, and the right edge of the right rod support 21 is substantially flush with the right edge of the right front support 12.

Preferably, as shown in FIGS. 1 & 3–6, the rod supports 20,21 are made with sufficient room within them for the rod 19 to move freely and to permit adjustments, upon assembly of the blocker, in the angle between the side supports 13,14 and the front supports 11,12 in order to accommodate installation into inlets having varying side wall configurations. Preferably, the available range of adjustment is 30 degrees in all directions.

As shown in FIGS. 1–10, a grid 22 is connected at or near its top edge to the rod 19. The grid 22 hangs from the rod 19 and swings about the axis of the rod 19. The grid 22 has a closed position, as seen in FIGS. 2–4, 6, and 8–10; and, when in its closed position, substantially fills the portion of the inlet 2 that is not covered by the front supports 11,12. The connection between the grid 22 and rod 19 preferably, as shown in FIGS. 4–6, is made by welding the grid 22 to the rod 19 at points where they are in contact with one another. However, in other embodiments (not shown except as in FIGS. 7–10), the connection can be made using any other conventional connection means, such as clamps or brackets forming a sleeve around the rod and welded or clamped to the grid, bolts or screws into or through the grid and rod, loops or hooks through the grid and around the rod, hinging the grid to the rod, or adhesives applied where the grid and rod contact each other. Although, in the embodiments shown in FIGS. 1–10, the rod 19 turns freely, other embodiments (not shown) wherein the rod is fixed can use any of the conventional connection means that hingidly connects the grid to the rod. It should be noted that considerable strength and rigidity is added to the rod 19 and grid 22 combination when they are welded together.

The grid 22 preferably is substantially rigid and able, without significant distortion, to withstand at least the amount and distribution of static hydraulic pressure it would experience if, in its closed position, the grid 22 were blocking water that had accumulated to a depth rising from the inlet floor 8 to the top of the grid 22. A significant factor in achieving a sufficiently strong and rigid grid 22, in addition to the type and thickness of material used in its construction, is its shape. Preferably, the cross sectional shape of the grid 22, as shown in FIGS. 4–5 looking through III—III and in FIG. 10 looking through VII—VII, is substantially in the form of one-half of an elongated rectangle, with a top rearward extended portion 23 and a bottom rearward extending portion 24. Forming the grid 22 in this shape significantly increases its strength and rigidity, without any appreciable increase in its weight or size, and enhances the convenience and economy of making the grid 22. Bending the grid 22 to form the shape is a preferred method for making the rearward extended portions 23,24. However, in another embodiment (not shown), substantially the same shape of the grid can be formed by fixedly connecting, such as by welding, separate pieces to the top and the bottom of the flat grid to serve as the rearward extended portions 23,24. Such fixedly connected rearward extended portions 23,24 can be made from any conventional construction material, including but not limited to the grid material, that can be fixedly connected to the flat grid as described here and, when so connected, enhances the strength or rigidity of the grid. Other embodiments (not shown) can have a grid made in any other suitable shape that provides the requisite strength and rigidity, such as a shape that has portions of the grid extended rearward not only on the top and bottom but also on the left side and right side of the grid, with each of said side portions having an opening adapted for the rod to pass through; or, a shape that has no rearward extended portions but is held in place and strengthened by a frame around two or more edges of the grid. As noted above, welding the grid to the rod also enhances strength and rigidity of the grid and of the rod.

FIGS. 1–3 and 6–8 illustrate that the grid 22 defines a plurality of grid apertures 25 that permit fluid to pass through the grid 22. Preferably, all the grid apertures 25 have substantially the same shape and size (except where the grid 22 is cut through at a grid aperture 25), since such grids generally can be made more efficiently and economically, and are more available commercially, than grids having grid apertures with varying sizes and shapes. Nevertheless, in other embodiments (not shown) the grid can have grid apertures of any other shape and size, or combination of shapes and sizes, that permit fluid to pass through the grid. The size of the grid apertures 25, particularly their minimum dimension across the opening, is selected by the user based upon the maximum size of trash the user has determined to allow through the closed grid, considering, as noted in the BACKGROUND OF THE INVENTION section, that some items having a dimension larger than that may nevertheless pass through the grid.

The grid 22 preferably is made from a single piece of expanded metal with grid apertures 25 of a relative size, shape, and pattern substantially similar to what is shown in the accompanying drawings. Those skilled in the art will be familiar with expanded metal and understand that it is the result of forming grid apertures in sheet metal by the application of tension to the sheet in the appropriate directions after a plurality of cuts are made in it. However, in other embodiments (not shown) the grid can be in the form of sheet metal with grid apertures punched out, a wire mesh, a grate, a screen, a filter, a strainer, or any other conventional form useful for obstructing the passage of trash, and can have grid apertures of any desired size, shape, and pattern—provided that the grid has the requisite strength, stiffness, and durability for performing the functions described herein in the environment into which it is being placed. Preferably, the grid 22 material is hot-dipped galvanized steel, but alternatively can be plastic, or any other suitable conventional material. The grid apertures 25 should be suitably sized to effectively block trash larger than a size predetermined by the user. Without limiting the scope of grid dimensions covered by the invention, the range of dimensions believed best for blocking the passage of trash into municipal street storm-water catch basins is a grid that has a height of 8 to 14 inches, a width of 3 to 8 feet, a thickness of ⅛ to 3/16 inch, and grid apertures with their smallest dimension being no larger than ¼ to 1½ inches.

In FIG. 5, which shows the grid 22 in an open position, it can be seen that the rod supports 20,21 must be located sufficiently below the inlet ceiling 10 to allow clearance for rotation of the top rearward extended portion 23 into a near vertical position when the grid 22 is fully opened.

Figure 9:
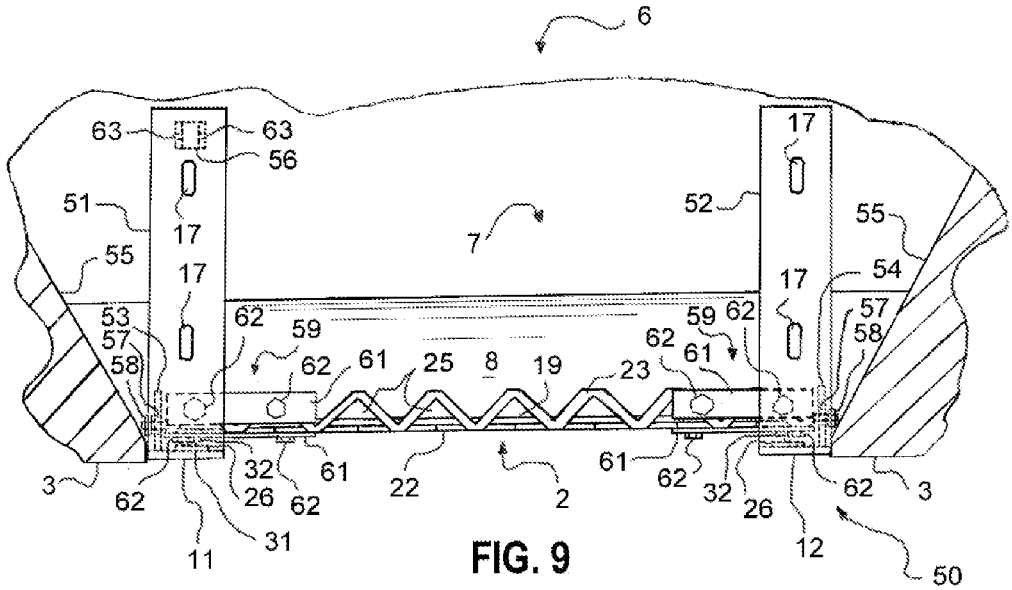
FIG. 9 is a cross-sectional view through VI—VI showing the top of the embodiment in FIG. 7, as installed in the curb inlet of a street storm-water catch basin.
Figure 10:
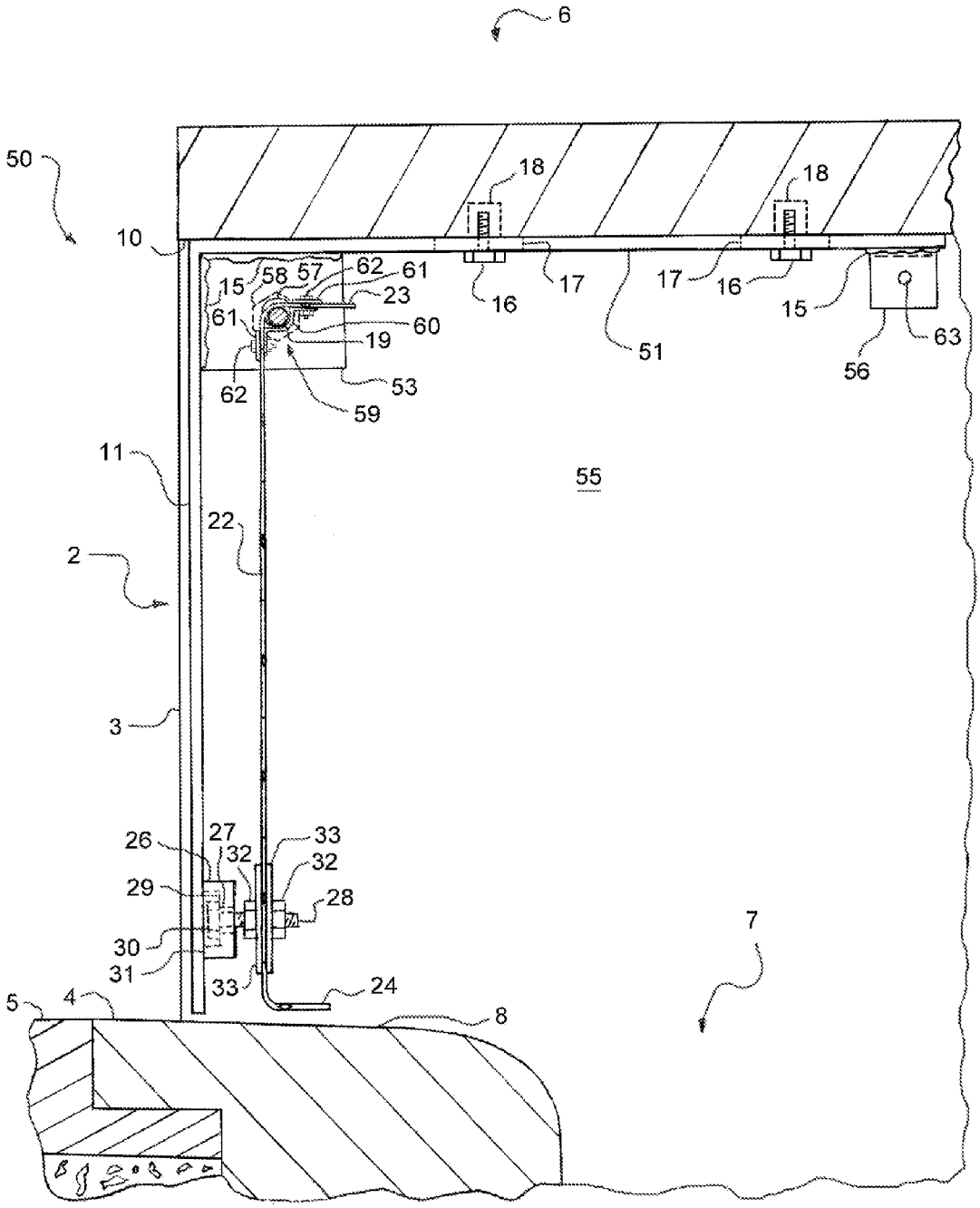
FIG. 10 is a cross-sectional view through VII—VII showing the left side of the embodiment in FIG. 7 in its closed configuration, as installed in the curb inlet of a street storm-water catch basin.

As shown in FIGS. 1, 3-7, and 9-10, the grid 22 has a magnet 26, connected to it on its lower left front side and its lower right front side. (Note, however, that magnet 26 is not visible in FIG. 6 because it is concealed by parts that hold it to the grid, such as the magnet washer 33.) Other embodiments (not shown) can have grids with only one magnet or with more than two magnets, up to any reasonable number that can be useful for holding the grid in its closed position. Preferably, as seen in FIGS. 4, 5, and 10, each magnet 26 has a magnet hole 27 through it adapted to receive a magnet bolt 28, and has a recessed center 29 adapted to seat the magnet bolt head 30 so that it does not protrude beyond the magnet contact surface 31. Each magnet bolt 28, preferably, as shown in FIGS. 4,5, & 10, is connected to the grid 22 by passing the magnet bolt 28 through the grid 22, with the magnet bolt 28 having a magnet nut 32 and magnet washer 33 on the front side of the grid 22 and on the back side of the grid 22, wherein the magnet nuts 32 are tightened against the magnet washers 33 from opposite sides, clamping the magnet washers 33 against and gripping the grid 22. This method of connection permits each magnet bolt head 30, and magnet 26, to be separated from the magnet nut 32 and magnet washer 33. Each magnet hole 27 preferably, as shown in FIGS. 4,5, & 10, is larger in diameter than the diameter of the magnet bolt 28. Preferably, the separation of the magnet 26 from the magnet nut 32 and of the magnet bolt 28 from the wall of the magnet hole 27 are sufficient to permit the magnet contact surface 31 to rotate, preferably up to 30 degrees, horizontally and vertically. Such freedom to rotate enables the magnet contact surface 31 to align itself, where necessary, and make full contact with the back of its respective front support 11,12.

In other embodiments (not shown), the magnet can be connected to the grid by any conventional means such as clamping the magnet washers against the grid by having the magnet bolt head tighten against the magnet forcing the magnet against the front magnet washer, causing the front magnet washer to grip the grid. And, in still other embodiments (not shown) in which the front supports are made of a material that does not attract magnets, such as aluminum or plastic, any conventional magnet-attracting material, such as a plate made of galvanized or stainless steel, can be secured by any conventional means to the back of, or incorporated into, each of the front supports at a location where the magnet will contact the plate, or the support if the magnet-attracting material is incorporated into it, when the grid is in the closed position.

While in contact with the front support 11,12 (or metal plate as the case may be), the magnets 26 hold the grid 22 in the closed position. The grid 22 blocks the passage of trash, which accumulates, resulting in a damming effect on the incoming fluid, a slowing or stopping of the fluid flow and rise in fluid level at the grid, and, thus, a build up of pressure against the grid. The pressure against the grid 22 communicates forces to the resisting magnets 26. The conditions under which the grid 22 will open are based on the pull limit of the magnets 26 and their location on the grid 22. When the force resulting at any particular magnet 26 location from the pressure against the grid 22 reaches the pull limit of the magnet 26, the magnet 26 detaches. When all the magnets 26 have detached, the grid 22 is released and opened by the downstream movement of the accumulated trash and fluid forcing it to rotate rearward, allowing the passage of the accumulated solids. The blockage is thereby eliminated and the fluid is able to flow through the channel substantially unobstructed.

The relationship between pressure—whether distributed evenly or in a known or assumed pattern—against a surface of known dimensions, and the forces needed at selected points on the surface or periphery of the surface to resist the pressure, is known or readily available to those skilled in the art. Therefore, Control over the opening of the grid 22 is accomplished by proper selection (based upon pull limit) and location on the grid 22 (or grid frame) of the magnets 26.

The magnet 26 pull limit and location are selected based upon the dimensions of the grid 22 and the predetermined release conditions established for opening the grid 22, although the selection may also be based on any other factors deemed significant by the user such as use of tolerances to account for anticipated variations in the installation environment that may cause the pull limit to change from time to time. The magnet 26 is located so that its pull limit is only slightly less than the opposing force expected to result at the selected location when there is an occurrence of the predetermined release conditions. When the pull limit of one or more of the magnets 26 is overcome, each such magnet 26 detaches. The other magnet 26, or other magnets 26 if more than two were being used, must then absorb more of the force pressing against the grid 22 and will likely reach its (or their) pull limit(s) and detach quickly. When all the magnets 26 have detached, the grid 22 is released. The resulting downstream movement of the accumulated trash and fluid past the grid 22 force it open enough for the accumulated trash and fluid to pass downstream. Thus, the release occurs only when desired, and may easily be changed from time to time by changing the magnets 26 to ones with different pull limits or relocating them, or both.

When the accumulated trash has been released downstream and has cleared the grid 22, and the pressure against the grid 22 has thus subsided, the grid 22 is rotated toward the closed position by gravitational force, assisted, where they are installed, by one or more springs or other torque-inducing means, which can be as simple as weights added to the bottom of the grid (not shown), and further assisted by the magnets 26 as they come into close proximity with the front supports 11,12. Upon re-closing, the grid 22 is once again held in that position by the magnets 26 until the next episode of heavy fluid flow and accumulation of solids causes a recurrence of the predetermined release conditions.

In other embodiments (not shown), the magnets can be replaced by, or combined with, other hold-release means, such as a latch or other mechanical gripping device (which generally require that one part of the device be connected to the support and another part be connected to the grid), provided that such other hold-release means is suitable for operation in the channel environment and has characteristics substantially similar to magnets of equal pull limit, with regard to the ability to hold, automatically release, and automatically resume holding the grid, and to repeat such cycle as often as deemed necessary by the user of the blocker.

It is believed that those skilled in the art will be able to readily determine what predetermined release conditions are appropriate for a particular installation and what selection and placement of the magnets or other hold-release means is suitable for effecting release under those conditions and reclosure when those conditions have dissipated.

As an example and not a limitation, the use of two magnets having a pull limit of 40 pounds each, with one located at each bottom corner of a grid having dimensions of approximately 8 inches in height (when in the closed position) and 7 feet wide, has been found to work effectively to resist inadvertent opening yet release when the accumulation of trash causes the water level on the front to rise approximately half the height of the grid. Also as examples and not limitations, use of 2 magnets with pull limits of only 3 to 15 pounds each, similarly placed on grids that also have heights of 8 inches but shorter widths, such as 3 to 5 feet, are believed to be effective under some circumstances where avoiding large buildups of trash is an important consideration and there is little likelihood of inadvertent forces occurring and causing unintended openings—which openings not only may interfere with proper resetting of the grid in its closed position but also may pose a safety problem where children have access to the area.

Preferably, as shown in FIGS. 4–6, the top of the left rod support 20, or at least its back vertical part, is located sufficiently below the inlet ceiling 10 to provide clearance for the rod 19 to pass over the back of the rod support 20. The right rod support 21 is similarly located relative to the inlet ceiling 10. Thus, the rod 19 can be inserted and removed while the front supports 11,12 and side supports 13,14 (or top supports for a top mounted blocker using rod supports) are installed in the inlet 2. Preferably, as shown in FIGS. 3–6, the rod 19 is secured against being jostled up and out of the left rod support 20 by a set screw 34 passing through and screwed into the left front support 11, wherein the fully-inserted set screw 34 extends over and beyond the rod 19 without touching or otherwise interfering with the operation of the rod 19 or grid 22. Preferably a set screw 34 is placed above each end of the rod 19, as shown in FIGS. 1–3, with the set screw 34 installation on the right side being substantially the mirror image of the set screw 34 installation on the left side. But, other embodiments (not shown) can use only one set screw, placed over the end of the rod that is deemed most likely to be jostled out of the rod support. The set screw 34 is easily removed, with the proper tool, to allow removal of the rod 19. The ability to insert and remove the rod 19 in this fashion improves the ease, efficiency, and economy of installing and maintaining the blocker. (Thus, the term "set screw," as used herein, refers to a preferred form of adjustable rod-retainer piece adapted for securing the rod against being jostled out of the rod support as described and shown herein, so is not limited to dictionary definitions. As described and shown, set screw 34 is set by screwing it into a position above and across the rod.)

FIGS. 3–6 illustrate the use of a spring 35 to assist in reclosing the grid 22 after it has been forced open. The spring 35 is connected, preferably by welding as shown in FIGS. 4–6, to the back side of the front support 11, and then extends downwardly in front of the rod 19 and is wrapped around the rod 19 in the same angular direction as when the grid 22 is moved from its closed position to an open position. The number of turns made by the spring 35 around the rod 19 is optional, but preferably it is at least two. The free end of the spring 35 is pointed downwardly and extended through a movable sleeve 36 that runs through a spring bracket 37. The spring bracket 37 is fixidly connected to the grid 22, preferably by welding as shown in FIGS. 4–6. Thus, as the grid 22 opens, the spring 35 is tightened, increasing the torque it imparts to the grid 22 through the spring bracket 37 while the movable sleeve 36 permits the free end of the spring 35 to move outwardly and inwardly as the opening and closing rotation of the grid 22 causes the spring 35 to wrap and unwrap around the rod 19. After the grid 22 has released its accumulation of trash, thus losing most of the force that caused it to open, the tightened spring 35 assists gravity in returning the grid 22 to its closed position. The spring 35 is selected based upon the amount of torque needed or desired to achieve prompt return of the grid 22 to its closed position during a heavy flow period; upon the physical limitations on size due to the presence of other parts of the blocker in a confined space; upon the durability and resiliency of the material the spring 35 is made of; and, upon any other factors deemed important by the individual user. Preferably, the spring 35 is made of stainless steel.

In other embodiments (not shown), more than one spring can be used such as by placing one near each end of the rod, in which case the second spring installation would be substantially the mirror image of the first. The use of two springs is preferred for grids that are wider than approximately 5 feet. And, in still other embodiments (not shown), the spring can be replaced by any other conventional means of applying torque to the grid, such as by welding one end of a suitably sized torsion bar to one of the side supports and the other end of the torsion bar to the most proximate end of the rod.

To slow the speed at which the grid 22 closes after its opening force has dissipated, the side-mounted blocker 1 shown in FIGS. 1 & 3–6 has a damper 38. The damper 38 in the embodiment shown, is a conventional pneumatic damping device that is comprised of a cylindrical body 39, a shaft 40 that movably extends into and out of one end of the body 39 along its centerline in response to a push and pull respectively on the shaft 40, a shaft eyelet 41 on the end of the shaft 40 directed away from the body 39, and a base eyelet 42 fixidly connected to the base of the body 39. The base eyelet 42 defines an aperture that has a base throughbolt 43 passing through it. The shaft eyelet 41 defines an aperture that has a shaft throughbolt 44 passing through it. The throughbolts 43,44 each pass through their respective eyelet 41,42 substantially at a right angle to the centerline of the body 39 and substantially perpendicular to the plane containing the arc traced by a point on the installed grid 22 when the grid 22 is rotated from its closed position to an open position. Each eyelet 41,42 is adapted to rotate freely about its respective throughbolt 43,44. The base throughbolt 43 is threaded into a damper separator post 45 that both connects the damper 38 at its base to the left side support 13 and separates the damper 38 from the left side support 13, thereby providing clearance for the body 39 to rotate about the base throughbolt 43. Preferably, the separator post 45 is connected to the left side support 13 by welding. The shaft throughbolt 44 connects the damper 38 at the shaft eyelet 41 to a shaft connector bracket 46, which has a shaft bolt hole 47 through which the shaft throughbolt 44 passes to thread into a shaft connector nut 48. The shaft connector bracket 46 is fixidly connected, preferably by welding, to the grid 22. Eyelets 41,42 are buffered on the side opposite the heads of the throughbolts 43,44 by eyelet washers 49; although, in other embodiments (not shown), the throughbolts 43,44 can have threaded locking nuts located adjacent to, or replacing, the eyelet washers 49. The damper separator post 45 and the shaft connector bracket 46 are adapted to assure that, upon final assembly with the blocker installed in the inlet 2, the damper 38 will rotate easily about the base throughbolt 43 and the shaft throughbolt 44, will not obstruct the operation of the grid 22, and will not be subjected to significant side forces when the grid 22 is rotated from closed to fully open and form fully open to closed. Thus, as illustrated by a comparison of FIGS. 4 & 5, the shaft 40 is pushed into the body 39 as the grid 22 opens and is pulled out of the body 39 as the grid 22 closes. (As used herein a throughbolt preferably is a bolt with threads substantially only on the portion(s) that, when fully inserted, will be threaded into another piece or nut.)

The damper 38 is selected based upon the size and weight of the grid 22 and speed at which the user wishes to have the grid 22 close after opening and releasing its accumulation of trash. The selection is also based upon whether or not a spring is being used, and upon the torsion strength (torque) of any spring or set of springs that are used. Preferably, the damper 38 selected provides substantially more resistance to pulling than to pushing, so that its governing effect is concentrated on closing rather than opening, although using a damper 38 that governs against opening too rapidly may also be desirable in some applications. Any conventional form and type of damper can be utilized that can be fitted and connected to the grid and to some stationary position, where the connections are rotatable connections if the damper requires such rotation in order to operate while connected to the grid, and has the ability to at least slow the rate of closure of the grid.

Other embodiments (not shown), can have a damper on the right side rather than the left side, or on both sides of the blocker, in which case the installation on the right side can be substantially the mirror image of the installation on the left side. Placing a damper on both sides is generally preferable when a large grid such as one that is five or more feet wide is being installed.

Other embodiments, such as the one shown in FIGS. 7–10, can operate without installation of a damper, a spring, or either.

Figure 7:
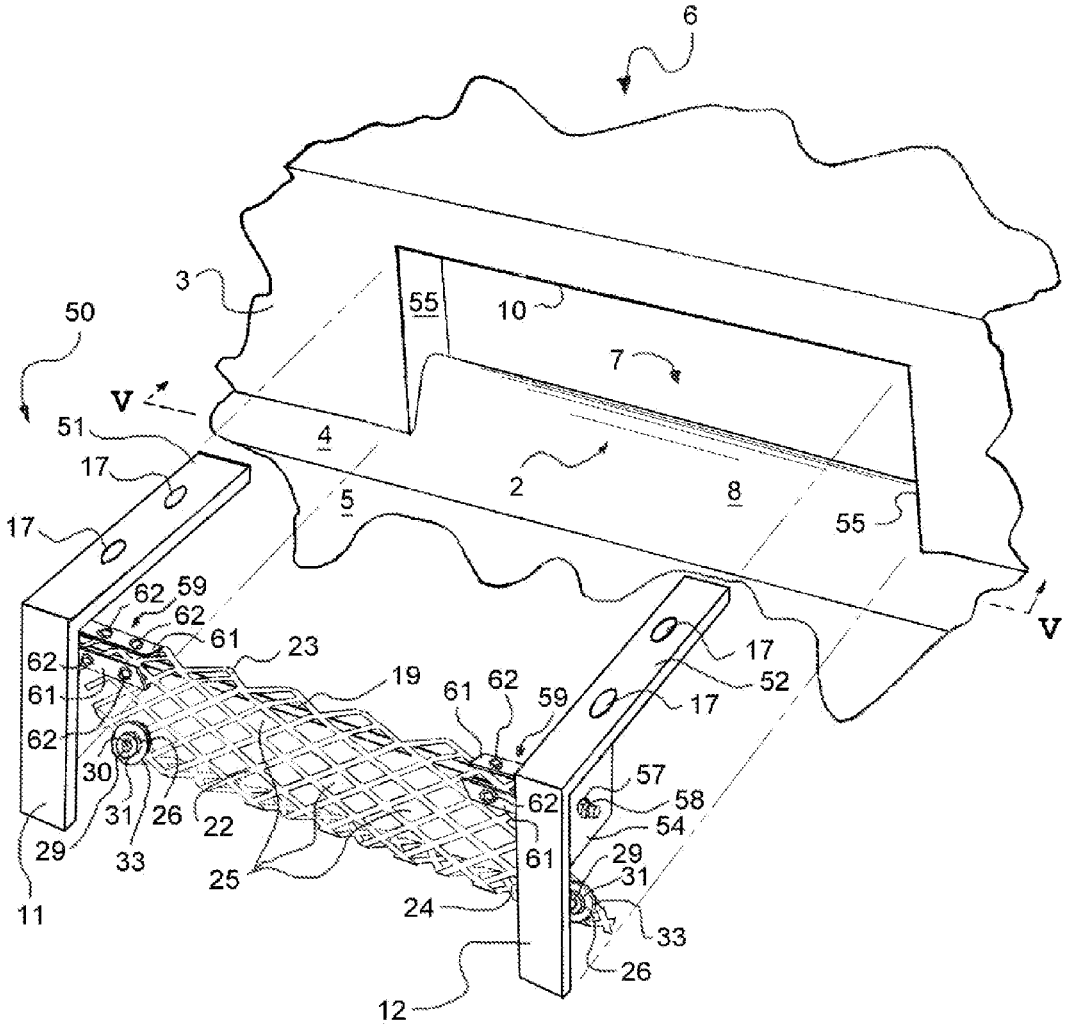
FIG. 7 is a perspective view of a second preferred embodiment of the invention apparatus adapted for attachment to the ceiling of the curb inlet of a street storm-water catch basin, prior to installation.

FIG. 7 shows a perspective view of a top-mounted blocker 50, without its support bolts 16. Its position relative to the pre-existing curb inlet 2 prior to installation is similar to that shown in FIG. 1 for the side-mounted blocker 1. The top-mounted blocker 50 is an embodiment that is substantially the same as the side-mounted blocker 1 with a few notable exceptions. As a result, where a component of the top-mounted blocker 50 is substantially similar to a component of the side-mounted blocker 1, references to it in describing the top-mounted blocker 50 utilize the same name and number that are used in describing that component in the side-mounted blocker 1. Furthermore, in view of this substantial similarity between the two embodiments, all other portions of the description of the side-mounted blocker 1 should be read as also applying to the top-mounted blocker 50 except those portions that clearly do not so apply and except as specifically set forth below.

The top-mounted blocker 50 shown in FIGS. 7–10 represents a basic configuration that has no spring, damper or related parts. The top-mounted blocker 50 shown in FIGS. 7–10 has a left front support 11, a right front support 12, a left top support 51, a right top support 52, a left end plate 53, a right end plate 54, a rod 19, a grid 22, and two magnets 26. The top supports 51, 52 are each shown with two support bolt holes 17. These figures show that top supports 51, 52 and front supports 11, 12 form a pair of (left and right) support structures of the illustrated top-mounted blocker 50 for mounting grid 22 within inlet 2, with each of the top supports 51, 52 exemplifying a conventional mounting support for connecting the support structure of which it is a part, to ceiling 10.

In FIG. 7, the inlet 2 has tapered walls 55 instead of the straight side walls 9 shown in FIG. 1. The separation between the tapered walls 55 increases significantly as one moves deeper into the inlet 2, which may make installing a side-mounted blocker 1 extremely difficult, but, as illustrated in FIG. 9, poses no added difficulty when installing a top-mounted blocker 50.

FIGS. 7, & 9 show the configuration and positioning of the top supports 51, 52, and FIG. 10 shows further details with respect to the left top support 51, which, except for an optional two-flanged damper bracket 56 being shown on the left top support 51, is a mirror image of the right top support 52. It should be apparent from a comparison of the top supports 51, 52 in FIGS. 7, 9 & 10 with the side supports 13,14 in FIGS. 1, 3–6, that the top supports 51, 52, are simply adaptations of the side supports 13,14 that have been moved from the side to the tops of the front supports 11,12. This is best seen by imagining the side supports 13,14 being disconnected from their respective front supports 11,12 and other parts shown in FIGS. 1, 3–6, and then rotated around their longitudinal axes by ninety degrees, widened, and reconnected to the tops of their respective front supports 11,12. Although the connection between the front supports 11,12 and the top supports 51, 52 can be made by any conventional connecting means such as those shown and mentioned herein with respect to connecting the front supports 11,12 to the side supports 13,14, the preferred method of forming the "L" shaped support structure that results from such connection is to do so from a single piece by bending, pressing, or stamping it.

As shown in FIGS. 7 & 9–10, the end plates 53,54 are used for holding the rod 19 rather than the rod supports 20,21 shown in FIGS. 1 & 3–6. The end plates 53,54 are oriented in a substantially vertical plane and welded into the inside corner of the "L" shape formed by the intersection of each front support 11,12 with its respective top support 51,52. Other embodiments (not shown) can have the end plates connected only to their respective front supports or top supports; and, can have the end plates located at different positions along the axis of the rod from what is shown in FIGS. 7 & 9. The end plates 53,54 preferably are located, depending on the space available in the intended installation environment, at a point that is indented from the outside edges of their front supports 11,12, as shown in FIG. 9. Each end plate 53,54 has an end-plate hole 57 through it for receiving an end of the rod 19. One end of the rod 19 extends through one of the end-plate holes 57 and the other end of the rod 19 extends through the other end-plate hole 57, with each end of the rod 19 being secured against sliding out of the end plate holes 57 by an end-plate nut 58 or, alternatively, by a cotter pin (not shown) or other conventional means (not shown) for so securing the end of the rod 19. Preferably, as shown in FIGS. 7 & 9, the end-plate holes 57 are sufficiently larger in diameter than the portion of the rod 19 that passes through them, and the end-plate nuts 58 are sufficiently separated from the end plates 53,54, to permit the rod 19 to rotate freely within the end-plate holes 57 and to allow for angular adjustments, preferably up to 30 degrees in any direction, between the rod 19 and the end plates 53,54, in order to facilitate installation into inlets 2 having irregular inside configurations.

As shown in FIGS. 7–10, the grid 22 is not connected to the rod 19 by welding but is, instead, connected by a sleeve bracket 59 on the right and left ends of the grid 22, each sleeve bracket 59 having a sleeve part 60 positioned under and behind the rod 19, a back plate 61 positioned on the front of the grid 22 and another back plate 61 positioned on the top of the grid 22. Each back plate 61 is tightened toward the sleeve part 60 by two bolt and nut assemblies 62, thereby clamping against and gripping the grid 22, and forming a sleeve around the rod 19. This means of connection can be made with the sleeve part 60 sufficiently loose around the rod 19 for the grid 22 to swing freely without requiring the rod 19 to rotate with it.

Figure 8:
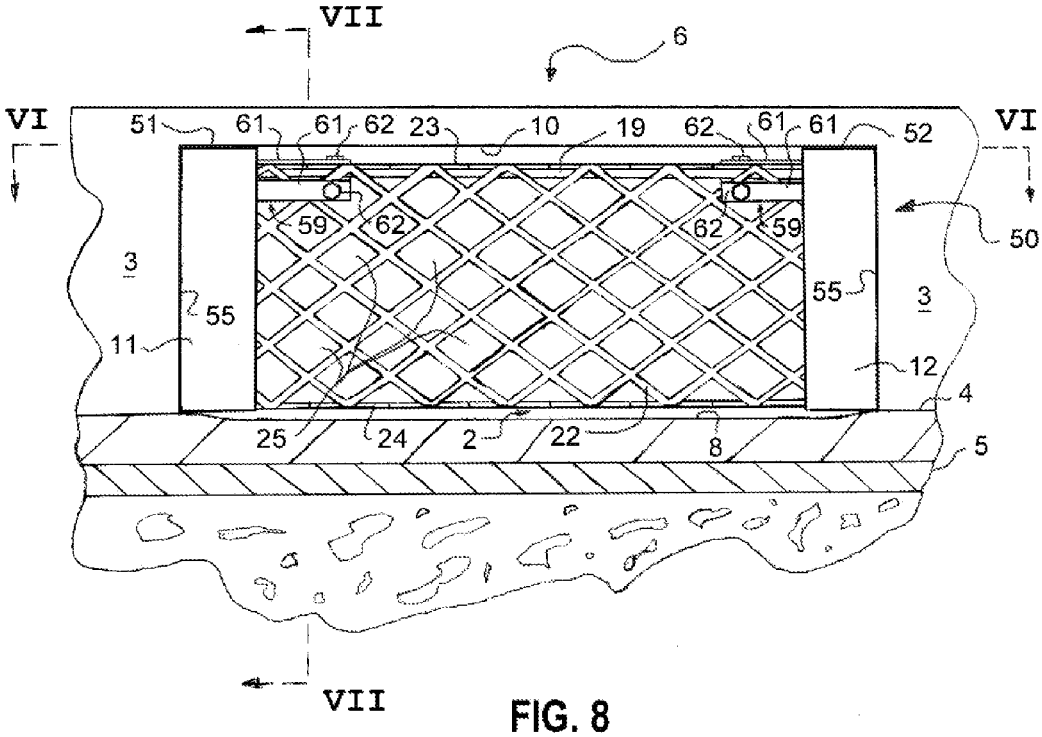
FIG. 8 is a cross-sectional view through V—V showing the front of the embodiment in FIG. 7, as installed in the curb inlet of a street storm-water catch basin.

FIGS. 7, 9,10 show the grid 22 with magnets 26 connected to it in the same way as described with regard to the side-mounted blocker 1. FIGS. 7 shows the grid 22 of the top-mounted blocker 50 open slightly, just as it is shown in FIG. 1 for the side-mounted blocker 1, and FIGS. 8–10 show it closed, just as it is shown in FIGS. 2–4 for the side-mounted blocker 1. Although not shown separately, an open position of the grid 22 on the top-mounted blocker 50 will be substantially the same as shown in FIG. 5 for the side-mounted blocker 1. Thus, it can be seen that the grid 22 on the top-mounted blocker 50 opens and closes in substantially the same way as described in connection with the side-mounted blocker 1. Of course, movement of the grid 22 shown in FIGS. 7–10 is not assisted by spring 35 or damper 38, since that embodiment does not have any spring or damper installed.

FIGS. 7–10, however, show the optional two-flanged damper bracket 56 welded to the underside of the left top support 51, the damper bracket 56 being adapted to loosely receive the damper base eyelet 42 between its two flanges, each of which has a bracket hole 63 for receiving the base throughbolt 43. Thus, if the grid 22 has a shaft connector bracket 46 connected to it as shown in FIGS. 1 and 3–6, a damper 38 can be easily added by rotatably connecting the shaft eyelet 41 to the shaft connector bracket 46 as shown in FIGS. 4–6, and rotatably connecting the base eyelet 42 to the damper bracket 56 by passing the base throughbolt 43 through one bracket hole 63, the base eyelet 42, and then the other bracket hole 63 and securing the base throughbolt 43 by threading it into a conventional nut (not shown).

The top-mounted blocker 50 also can have one or more springs 35 connected to it in the same way as described in connection with the side-mounted blocker 1.

The top-mounted blocker 50 can be made with the end plates 53,54 replaced by the rod supports 20,21 shown in FIGS. 1 & 3–6. If that is done, references to clearance between the rod supports 20,21 and the inlet ceiling 10 become, instead, references to clearance between the rod supports 20,21 and the top supports 51,52.

In other embodiments (not shown), the front supports 11,12 can be made non-rectangular to better fit against the irregular channel side walls, and the outer edges of the grid 22 also can be made non-linear to better conform to the non-linear version of the front supports 11,12 and the irregular side walls, or to meet any other requirements of the particular installation.

In other embodiments (not shown) the side supports 13,14 can be removed, reoriented, adapted and reconnected on or proximate to the bottom or anywhere else around the outside periphery of the front supports 11,12, essentially in the same manner as described herein with respect to converting them into top supports 51,52 for the top-mounted blocker 50. Thus, an embodiment can, without departing from the present invention, have a support structure with a mounting support that is, for example, similar to one of the side supports 13, 14 but adapted (e.g., oriented and connected appropriately relative to the embodiment's front support) to make the mounting support suitable for connecting the support structure to any surface of a channel (for example, inlet floor 8). And, of course, the support structure can have more than one mounting suport (e.g., for connecting the support structure to one channel surface more securely and/or to more than one channel surface) without departing from the present invention.

As an option to using a single blocker to block an inlet or other channel that is quite wide, each embodiment described herein can be installed as a collection of individual blockers and connected together side-to-side, to provide very effective and easily constructed and maintained wide-channel coverage.

Although the present invention was developed primarily for use in a channel comprising a catch basin, the present invention is not limited to such channels.

Although in the foregoing descriptions, the blocker is mounted close to the entry point to the inlet 2, the positioning of the blocker is not limited to such location. The blocker can be mounted at any accessible point within any fluid-flow channel wherein a mounting surface exists or can be constructed.

A method for controlling the flow of fluids into or through a channel using the invention is as follows.

An appropriate embodiment of the blocker is installed in the channel and put in its closed configuration when there is no significant fluid flow in the channel.

During periods of fluid flow, into or through the channel, by use of the blocker, intercept the free flow of trash being moved by the fluid into or through the channel. Most of the trash—certainly any item of trash with no dimension (when in its compressed state) as small as the predetermined minimum dimension of the grid apertures—is thereby blocked.

Accumulate the trash on the upstream side of the blocker by holding its grid in the closed position, thereby blocking and accumulating trash, until there is an occurrence of the predetermined release conditions.

Upon such occurrence of the predetermined release conditions, automatically release the accumulated trash by having the blocker set up for the grid to automatically release under those conditions.

Upon the accumulated trash passing downstream of the grid, automatically intercept the flow of trash once again by the blocker automatically returning the grid to its closed position.

Resume blocking the trash in the fluid flow and accumulating it upstream of the blocker by having the blocker set up to hold the grid in its closed position pending a recurrence of the predetermined release conditions. This concludes one release cycle.

Upon recurrence of the predetermined release conditions, repeat the foregoing steps.

It is anticipated that during heavy flow periods no more than one release cycle, or, in long lasting or very unusually high flow periods, two or three release cycles, would be necessary.

At the conclusion of the heavy flow period, the trash not released downstream is retained at the front of the grid for removal by conventional means used for maintaining the streets and removing trash.

By using the blocker to practice the above method, a considerable degree of control is achieved over the conditions under which trash will be permitted into or through a fluid-flow channel. By exercising such control, use of the channel is significantly increased when most needed to minimize the potential for serious flooding or pressure build up, without sacrificing the ability to block trash at times when such use is not needed or less critical.

It is to be understood that the present invention is not limited to the embodiments and processes described above, but encompasses any and all embodiments and processes within the scope of the claims.

What is claimed is:

1. An auto-release trash blocking apparatus for use in fluid channels, comprisinga. a grid, the grid having a plurality of apertures adapted in size and shape to permit fluid to pass through the grid but to block at least some trash;

b. a support structure for mounting the grid within a channel, wherein the support structure is connected to at least one surface of the channel, wherein the grid is rotatably connected via a rotation means to the support structure and the grid is rotatable between positions that comprise a closed position and an open position, wherein, while in the closed position, the grid is positioned to intercept the path of at least some of the trash that is moved by the fluid flowing through the channel, and, while in the open position, the grid is positioned to permit at least some of the intercepted trash to move downstream from the closed position, and wherein the support structure comprises a front support;

c. a hold-release means for at least helping to hold the grid in the closed position until an occurence of predetermined release conditions, wherein said hold-release means releasably connects at least part of the grid to the front support and wherein said hold-release means releasably connects at least part of the grid from the front support in response to the occurence of predetermined release conditions, wherein pressure against the upstream side of the grid urges the grid toward the open position; and, wherein the hold-release means automatically releasably re-connects the at least part of the grid to the front support upon return of the grid to the closed position; and, d. a means for applying torque to the grid in a direction for rotating the grid between the open position and the closed position, said means for applying torque to the grid being comprised of the grid's weight, a torque-inducing means, or both the grid's weight and the torque-inducing means.

2. The apparatus of claim 1, further comprising a damper means for governing the rate of rotation of the grid.

3. The apparatus of claim 1, wherein the hold-release means comprises a magnet and a means for attaching the magnet to the at least part of the grid, wherein the front support comprises a magnetically attractive area with which the magnet interacts for pulling the at least part of the grid toward the front support.

4. The apparatus of claim 3, wherein the means for attaching the magnet is adapted to permit automatic adjustment of the magnet's orientation toward making a surface of the magnet face at least part of the magnetically attractive area when the grid rotates into the closed position.

5. The apparatus of claim 4, wherein the rotation means comprises a rod connected to the grid and a bracket connected to the support structure, wherein the bracket provides support for the rod and wherein the bracket comprises a bracket opening for insertion of at least part of the rod into the bracket, and wherein there is sufficient room between the inserted part of the rod and the inside of the bracket for the alignment of the rod within the bracket to vary within at least one plane.

6. The apparatus of claim 3, wherein the rotation means comprises a rod connected to the grid and a bracket connected to the support structure, wherein the bracket provides support for the rod and wherein the bracket comprises a bracket opening for insertion of at least part of the rod into the bracket, and wherein there is sufficient room between the inserted part of the rod and the inside of the bracket for the alignment of the rod within the bracket to vary within at least one plane.

7. The apparatus of claim 6, wherein the bracket comprises a rod-retainer piece adapted for retaining the rod within the bracket, wherein the rod-retainer piece is settable at a position whereat the rod-retainer piece acts as an impediment against movement of the rod through the bracket opening, and wherein the rod-retainer piece is sufficiently removable, adjustable, or both removable and adjustable relative to the bracket opening to eliminate said impediment to movement of the rod through the bracket opening.

8. The apparatus of claim 1, wherein the rotation means comprises a rod connected to the grid and a bracket connected to the support structure, wherein the bracket provides support for the rod and wherein the bracket comprises a bracket opening for insertion of at least part of the rod into the bracket, and wherein there is sufficient room between the inserted part of the rod and the inside of the bracket for the alignment of the rod within the bracket to vary within at least one plane.

9. The apparatus of claim 8, wherein the bracket comprises a rod-retainer piece adapted for retaining the rod within the bracket, wherein the rod-retainer piece is settable at a position whereat the rod-retainer piece acts as an impediment against movement of the rod through the bracket opening, and wherein the rod-retainer piece is suffucuently removable, adjustable, or both removable and adjustable relative to the bracket opening to eliminate said impediment to movement of the rod through the bracket opening.

10. The apparatus of claim 8, further comprising a damper means for governing the rate of rotation of the grid.

11. A method for controlling the obstruction of a fluid channel, comprising the following automatic steps:

a. blocking at least some trash from moving through a fluid-flow channel by using a grid installed and rotatably suspended within the channel, wherein the grid is rotatable between at least one closed position and at least one open position, wherein the blocking step comprises the steps of holding the grid in at least one of the closed positions by using one or more hold-release means, the one or more hold-release means releasably connecting at least part of the grid to one or more front supports, and permitting the flow of fluid through apertures in the grid from an upstream side of the gris to a downstream side of the grid while accumulating at least some of the trash on the upstream side of the grid;

b. releasing at least some accumulated trash, the releasing step comprising the steps of opening the grid, wherein opening the grid comprises the steps of physically disconnecting the at least part of the grid from the one or more front supports in response to an occurrence of predetermined release conditions, and allowing the grid to rotate into at least one of the open positions in response to the fluid and the trash acting on the grid, and thereby allowing at least some of the accumulated trash to bypass the grid;

c. returning the grid to at least one of the closed positions, wherein the returning step comprises allowing the grid to rotate from at least one of the open positions into at least one of the closed positions using the grid's weight, at least one conventional torque-inducing means; and, d. repeating the foregoing steps.

12. The method of claim 11, further comprising the step of governing the rotational rate of the grid using at least one damper means.

13. The method of claim 12, wherein at least one of the hold-release means comprises a magnet; and wherein the holding step further comprises pulling the at least part of the grid toward the front support using the magnet.

14. The method of claim 13, wherein the returning step further comprises permitting the orientation of the magnet to adjust upon the grid rotating into at least one of the closed positions.

15. The method of claim 11, wherein at least one of the hold-release means comprises a magnet and wherein the holding step further comprises pulling the at least part of the grid toward the front support using the magnet.

16. The method of claim 15, wherein the returning step further comprises permitting the orientation of the magnet to adjust upon the grid rotating into at least one of the closed positions.

17. An auto-release trash blocking apparatus for use in fluid channels, comprising a. a support structure, said support structure comprising a mounting support and a front support, wherein the front support is connected to the mounting support and the mounting support is adapted for connecting the support structure to an inner surface of a fluid-flow channel;

b. a grid having a plurality of apertures through it wherein the apertures are adapted in size and shape to permit the passage of fluid through the grid but not to permit such passage of at least some trash;

c. a rotation means for rotatably connecting the grid to the support structure, wherein said rotation means comprises a rod and a rod support bracket, the bracket being connected to the support structure, wherein the rod is supported at least in part by the bracket, the bracket having a bracket opening through which at least part of the rod is insertable int othe bracket, wherein the bracket provides sufficient room between the inserted part of the rod and the inside of the bracket for the angle of alignment between the rod and the bracket to vary, and wherein the grid is rotatable about the a longitudinal axis of the rod between positions comprising a closed position and an open position, wherein, while in the closed position, the grid is positioned to intercept the path of at least some trash while the trash is being moved by fluid through the part of the channel immediately upstream of the grid, wherein, when rotated into the open position, at least part of the grid is displaced downstream relative to where said at least part of the grid was located while the grid was in the closed position; and, d. a hold-release means, wherein said hold-release means comprises a magnet connected to the grid for at least helping the hold-release means maintain a releasable connection between the grid and the front support while the grid is in the closed position, and wherein the hold-release means is adapted to permit automatic adjustment of the magnet's orientation in response to the magnet or another part of the hold-releaes means making conatct with a stop surface, the stop surface being a surface, comprised by the front support, against which the magnet or another part of the hold-release means comes to rest when the grid rotates into the closed position.

18. The apparatus of claim 1, further comprising a torque-inducing means wherein the torque-inducing means applies torque directly or indirectly to the grid.

19. The apparatus of claim 18, further comprising a damper means, wherein the damper means governs the rotational rate of the grid in at least one rotational direction.

20. The apparatus of claim 17, further comprising a damper means wherein the damper means governs the rotational rate of the grid in at least one rotational direction.

* * * * *

UNITED STATES PATENT AND TRADEMARK OFFICE

CERTIFICATE OF CORRECTION

PATENT NO. : 7,491,338 B2
APPLICATION NO. : 10/794664
DATED : February 17, 2009
INVENTOR(S) : Khalil Ibrahim Nino It is certified that error appears in the above-identified patent and that said Letters Patent is hereby corrected as shown below:

Drawing sheet 2: FIG. 2 should include reference numeral 22 and a lead line going from proximate numeral 22 to the grid (structure, seen between left front support 11 and right front support 12, with grid apertures 25 through it).

Column 6: at line 36, “fullt” should read --fully--.

Column 18: at line 24, “suport” should read --support--.

Column 19: at line 54, “releasably connects” should read --automatically releases the--.

Column 21: at line 4, Claim 11 “gris” should read --grid--; and, at line 21, “the grid’s weight,” should be deleted.

Column 22: at line 13, Claim 17 “int othe” should read --into the--; at line 17, “the a” should read --a--; at line 34, “hold-releaes” should read --hold-release-- and “conatct” should read --contact--; and, at line 39, “claim 1” should read --claim 17--.

Signed and Sealed this
Fifth Day of July, 2011

David J. Kappos

David J. Kappos
*Director of the United States Patent and Trademark Office*